US010850373B2

(12) United States Patent
Vandenberg

(10) Patent No.: US 10,850,373 B2
(45) Date of Patent: Dec. 1, 2020

(54) METHODS OF USING A FASTENER GUIDE TO INSTALL A FASTENER

(71) Applicant: National Nail Corp., Grand Rapids, MI (US)

(72) Inventor: Roger A. Vandenberg, Hudsonville, MI (US)

(73) Assignee: NATIONAL NAIL CORP., Grand Rapids, MI (US)

( * ) Notice: Subject to any disclaimer, the term of this patent is extended or adjusted under 35 U.S.C. 154(b) by 0 days.

(21) Appl. No.: 16/442,924

(22) Filed: Jun. 17, 2019

(65) Prior Publication Data

US 2019/0329385 A1 Oct. 31, 2019

Related U.S. Application Data

(63) Continuation-in-part of application No. 15/915,391, filed on Mar. 8, 2018, now Pat. No. 10,576,612.

(51) Int. Cl.

| | |
|---|---|
| ***B25B 23/00*** | (2006.01) |
| ***B25B 21/00*** | (2006.01) |
| ***B25B 23/08*** | (2006.01) |

(52) U.S. Cl.

CPC ..... *B25B 23/005* (2013.01); *B25B 23/08* (2013.01); *B25B 21/007* (2013.01); *Y10T 29/49895* (2015.01); *Y10T 29/49947* (2015.01); *Y10T 29/53909* (2015.01)

(58) Field of Classification Search

CPC ..... B25B 23/005; B25B 21/007; B25B 23/00; B25B 23/02; B25B 23/04; B25B 23/08; E04F 13/0894; Y10T 29/49947; Y10T 29/49963; Y10T 29/49895; Y10T 29/5343; Y10T 29/53909

See application file for complete search history.

(56) References Cited

U.S. PATENT DOCUMENTS

| | | |
|---|---|---|
| X797078 | 8/1905 | Shelton |
| 3,604,488 A | 9/1971 | Wishart et al. |
| 3,965,950 A | 6/1976 | MacDonald |

(Continued)

FOREIGN PATENT DOCUMENTS

| | | |
|---|---|---|
| EP | 0338554 A2 | 10/1989 |
| EP | 0596669 A1 | 5/1994 |

(Continued)

*Primary Examiner* — Sarang Afzali

(74) *Attorney, Agent, or Firm* — Warner Norcross + Judd, LLP

(57) ABSTRACT

A fastener guide defines a downward opening funnel having an upper end that transitions to an elongated barrel in which a drive feature is movably disposed. The funnel can fit over an upright fastener so that a head is guided into and enters the barrel a distance so the drive feature can align and register with the head in the barrel before the drive feature advances the fastener through the funnel. The guide can include a guide sleeve and a biasing element interposed between the sleeve and the barrel to urge the barrel from a retracted mode to an extended mode. The barrel can telescope relative to the sleeve in transitioning from the extended mode to the retracted mode, for example, when the funnel engages a board and the drive feature advances the fastener. The biasing element can compress during this telescoping. Related methods of using the guide are provided.

16 Claims, 16 Drawing Sheets

(56) References Cited

U.S. PATENT DOCUMENTS

| | | | | |
|---|---|---|---|---|
| 5,083,483 | A * | 1/1992 | Takagi | B25B 23/045 81/434 |
| 5,927,163 | A | 7/1999 | Habermehl | |
| 6,601,480 | B1 * | 8/2003 | Habermehl | F16B 27/00 81/434 |
| 8,955,210 | B2 | 2/2015 | Vandenberg | |
| 10,427,279 | B2 | 10/2019 | Rensburg | |
| 10,576,612 | B2 * | 3/2020 | Vandenberg | B25B 23/005 |
| 2010/0083610 | A1 | 4/2010 | King | |
| 2019/0247984 | A1 * | 8/2019 | Sawa | B25B 23/00 |

FOREIGN PATENT DOCUMENTS

| | | | |
|---|---|---|---|
| EP | 2939790 | A1 | 11/2015 |
| GB | 846337 | A | 8/1960 |
| WO | 2017000962 | A1 | 1/2017 |

* cited by examiner

METHODS OF USING A FASTENER GUIDE TO INSTALL A FASTENER

BACKGROUND OF THE INVENTION

The present invention relates to tools, and more particularly to a tool and related method used to guide a tool bit or drive toward a fastener to facilitate installation of the fastener with the tool.

In the construction industry, there are many tools used to guide fasteners relative to a work piece. One example of a popular and durable tool is the CAMO® Marksman® Pro Tool, available from National Nail Corp of Wyoming, Mich. This tool is designed to efficiently guide fasteners at a predetermined angle directly into a side surface of a board. The fasteners are commonly referred to as "hidden fasteners" because they are generally hidden from view after installation with the tool.

Some hidden fasteners can be difficult to install due to their diminutive size and the location where they are installed. Where the fasteners are installed in crevices between boards, it can be difficult to mate and align the tool with the fastener to start the installation process. Further, if the head of the fastener is very small, it takes a careful, steady hand to align the bit of the tool with the head so that the tool can rotate the fastener using the tool. The problem of alignment can be exacerbated where the installer has poor vision. In some cases, it can take extra time to align the tool bit with the fastener. On a large job, where hundreds or thousands of fasteners are advanced into multiple work pieces, this alignment problem can be compounded, and can add time and labor cost to the job.

Accordingly, there remains room for improvement in the field of tools used to guide fasteners, and in particular, and alignment system to align a tool with a fastener and to properly and consistently engage the tool with the fastener for the driving activity.

SUMMARY OF THE INVENTION

A fastener guide and related method of use is provided. The guide can define a downward opening funnel having an upper end and an elongated barrel that is above the downward opening funnel and that transitions to and is in communication with the upper end. The funnel can be configured to be placed over a fastener so that a head of the fastener is guided into and enters the barrel, within which a drive feature can engage the head.

In one embodiment, the fastener guide can define a downward opening funnel that can fit over an upright fastener so that a fastener head is guided into and enters the barrel a distance so the drive feature can align and register with the head in the barrel before the drive feature advances the fastener through the funnel.

In another embodiment, the guide can include a guide sleeve that is movably joined with the elongated barrel, which itself can define a bore within which the fastener and drive feature can be positioned. The elongated barrel can be slidably or movably disposed within a portion of the guide sleeve. The elongated barrel can be operable in an extended mode in which it extends from the guide sleeve, as well as a retracted mode, in which a portion of it is retracted into or relative to the guide sleeve. The elongated barrel can transition between the extended mode to the retracted mode and vice versa.

In still another embodiment, the guide can include a biasing element interposed between the sleeve and the barrel to urge the barrel from the retracted mode to the extended mode when no external forces are exerted on the guide. The biasing element also can be configured to compress and store energy when an external force is exerted on the guide, for example, when the downward opening funnel is pushed against a board during a fastener advancing operation. In some cases, the barrel can telescope relative to the sleeve in transitioning from the extended mode to the retracted mode, for example, when the funnel engages the board and the drive feature advances the fastener.

In yet another embodiment, the biasing element can be a coil spring. The coil spring can be disposed adjacent the guide sleeve. The elongated barrel can include a projection that can engage a lower portion of the coil spring. An upper portion of the coil spring can be engaged against a portion, such as a rim of the guide sleeve. When the downward extending funnel engages a surface under force, the elongated barrel can be pushed into the guide sleeve. The coil spring can be compressed between the projection and the rim to store energy so that after the advancing operation, the elongated barrel and downward opening funnel can be automatically extended away from the guide sleeve.

In even another embodiment, the guide can include a bit is configured to engage a chuck of a power tool. The bit can include an elongated shaft that has an upper end and a lower end. The lower end can include the drive feature. The upper end can include an annular groove or recess. The guide sleeve can include a ring configured to engage the annular groove of the bit to secure the bit to the guide, yet still allow the bit to rotate relative to the guide sleeve and/or the elongated barrel. The bit can remain longitudinally stationary relative to the guide sleeve as the guide sleeve moves downward toward the downward opening funnel. The guide sleeve and the bit can move in unison.

In a further embodiment, the biasing element can be a coil spring and can surround the bit. For example, the coil spring can circumferentiate the elongated shaft of the bit.

In still a further embodiment, the drive feature can be oriented in the elongated barrel, when the elongated barrel is in the extended mode, such that when a head of a fastener is positioned in the guide, the head of the fastener enters the elongated barrel a distance of optionally less than 15 mm, less than 10 mm, less than 5 mm, between 1 mm and 15 mm inclusive, between 1 mm and 10 mm inclusive, or between 1 mm and 5 mm inclusive.

In another embodiment, the guide can include a base having a downward extending gap flange. The gap flange can extend downward from a bottom surface of the base. The gap flange can be disposed on opposite sides of the downward opening funnel, generally centered on a longitudinal axis of the elongated barrel and the downward opening funnel. The gap flange can be sized and configured to set a gap between boards placed adjacent one another before installation of a fastener.

In yet another embodiment, the guide can define an upward opening funnel above and transitioning to an upper opening of the elongated barrel. The upward opening funnel can be configured so that a drive feature can be guided by its surfaces, into the upper opening of the elongated barrel. From there, the drive feature can be aligned and quickly register with a head of the fastener so that the drive feature can be rotated and advance the fastener.

In still another embodiment, the guide can include a grasping region around the elongated barrel. The grasping region can be generally elongated and in some cases cylindrical, extending from the upper end of the downward opening funnel to the upward opening funnel. The exterior walls of the elongated barrel and the upward opening funnel can form all or part of the grasping region to reduce the weight and materials used to make the guide. The grasping region can be manually grasped by a user to position the guide adjacent an uptight fastener or near a work piece. Thereafter, the guide can be used to guide a drive feature, for example, a bit or a chuck, toward a head of a fastener so the drive feature can register with and rotate the fastener.

In yet another embodiment, the guide can be configured to releasably attach to a nose of an automatic fastener-driving tool. The guide can include a registration feature, such as a groove, to align the guide with the nose. The guide can include a mounting element, such as one or more arms, to join and mount the guide to the nose. Once mounted, the guide can be placed over an upright fastener, and can be used to align a drive feature with a head of the fastener to subsequently install the fastener.

In a further embodiment, a method of using the fastener guide is provided, including the steps of providing a fastener in an upright, vertical orientation, distal from a guide; moving the guide toward the fastener so that a downward opening funnel moves over a head of the fastener and the head enters into an elongated barrel above the downward opening funnel; rotating the head in the elongated barrel with a drive feature in the elongated barrel such that the elongated barrel rotationally constrains the head and drive feature; and advancing the head with the drive feature so that the head passes into the downward opening funnel from the elongated barrel with the drive feature engaged with the head.

In yet a further embodiment, the method can include moving a guide toward a fastener so that a downward opening funnel moves over a head of the fastener and the head enters an elongated barrel above the downward opening funnel in which the head engages a drive feature of a bit so that the head and drive feature can rotate in unison; rotating the head in the elongated barrel with the drive feature located in the elongated barrel such that the elongated barrel rotationally constrains the head and drive feature; and advancing the head with the drive feature so that the head passes into the downward opening funnel from the elongated barrel with the drive feature engaging the head, but so that the elongated barrel no longer rotationally constrains the head.

In yet another embodiment, the method can include utilizing a guide including a guide sleeve slidably associated with the elongated barrel. The elongated barrel can retract relative to the guide sleeve when the downward opening funnel engages a board into which the fastener advances. In some cases, the guide sleeve includes a stop and the elongated barrel includes a projection that engages the stop to prevent the elongated barrel from becoming disassociated from the guide sleeve.

In still another embodiment, the method can include associating a biasing element with the guide sleeve; urging the elongated barrel to an extended mode with the biasing element; engaging the downward opening funnel with the fastener head when the elongated barrel is in the extended mode; and compressing the biasing element when the downward opening funnel engages a board and the fastener advances into the board. Optionally, during this compression of the biasing element, the elongated barrel transitions to the retracted mode.

In still a further embodiment, the method can include moving the drive feature toward an upward opening funnel at a first angle relative to a longitudinal axis or barrel axis of the elongated barrel and engaging the drive feature against an interior wall of the upward opening funnel so that the drive feature moves along the wall toward an opening of the elongated barrel; and entering the drive feature into the elongated barrel such that the elongated barrel reconfigures the drive feature from the first angle relative to the longitudinal axis to a configuration substantially parallel to the longitudinal axis or barrel axis.

In even a further embodiment, the method can include positioning the downward extending gap flange in a gap between adjacent boards, and using that gap flange to set the final gap between the boards before the boards are secured in place. The bottom surface of the base can engage an upper surface of a board to orient a barrel axis of the elongated barrel orthogonal to a plane parallel to the upper surface of the board. The fastener can be advanced downward within the gap, but without advancing into the board.

In yet even another embodiment, where the guide includes an upward opening funnel, the method can include moving the drive feature into the funnel, and sliding the drive feature along an interior wall of the funnel downward toward an opening of the elongated barrel. The head can be engaged a first time with the drive feature while the head and the drive feature are located in the elongated barrel above the downward opening funnel.

In another further embodiment, the method can include placing a downward opening funnel over an upright, substantially vertical fastener; moving the guide so that the head of the fastener enters an elongated barrel above the downward opening funnel; setting a base on an upper surface of a board adjacent the fastener to secure the guide and barrel in an upright position to maintain the fastener in a vertical, upright position; guiding a drive feature of a tool into the upper opening of the elongated barrel so that the drive feature registers with the fastener in the barrel; and advancing the fastener with the drive feature.

The current embodiments of the fastener guide and related method of use provide benefits in fastener installation fastener alignment and tool-to-fastener alignment that previously have been unachievable. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figures 3, 3A:
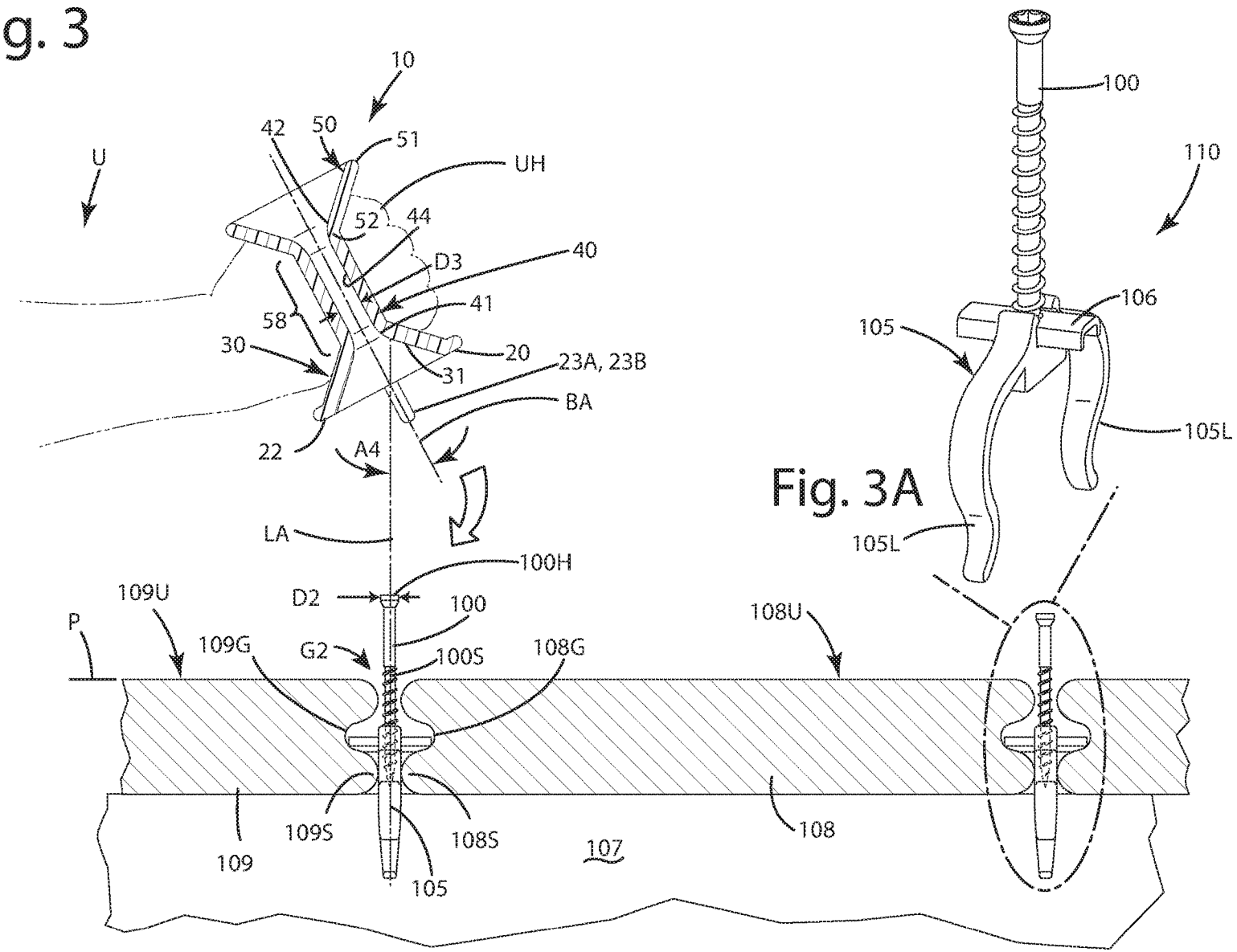
FIG. 3 is a section side view of the fastener guide taken along line 3-3 of FIG. 1, with the guide being moved toward a fastener in an upright, vertical position.
FIG. 3A is a perspective view of an optional clip used with a fastener.
Figure 4:
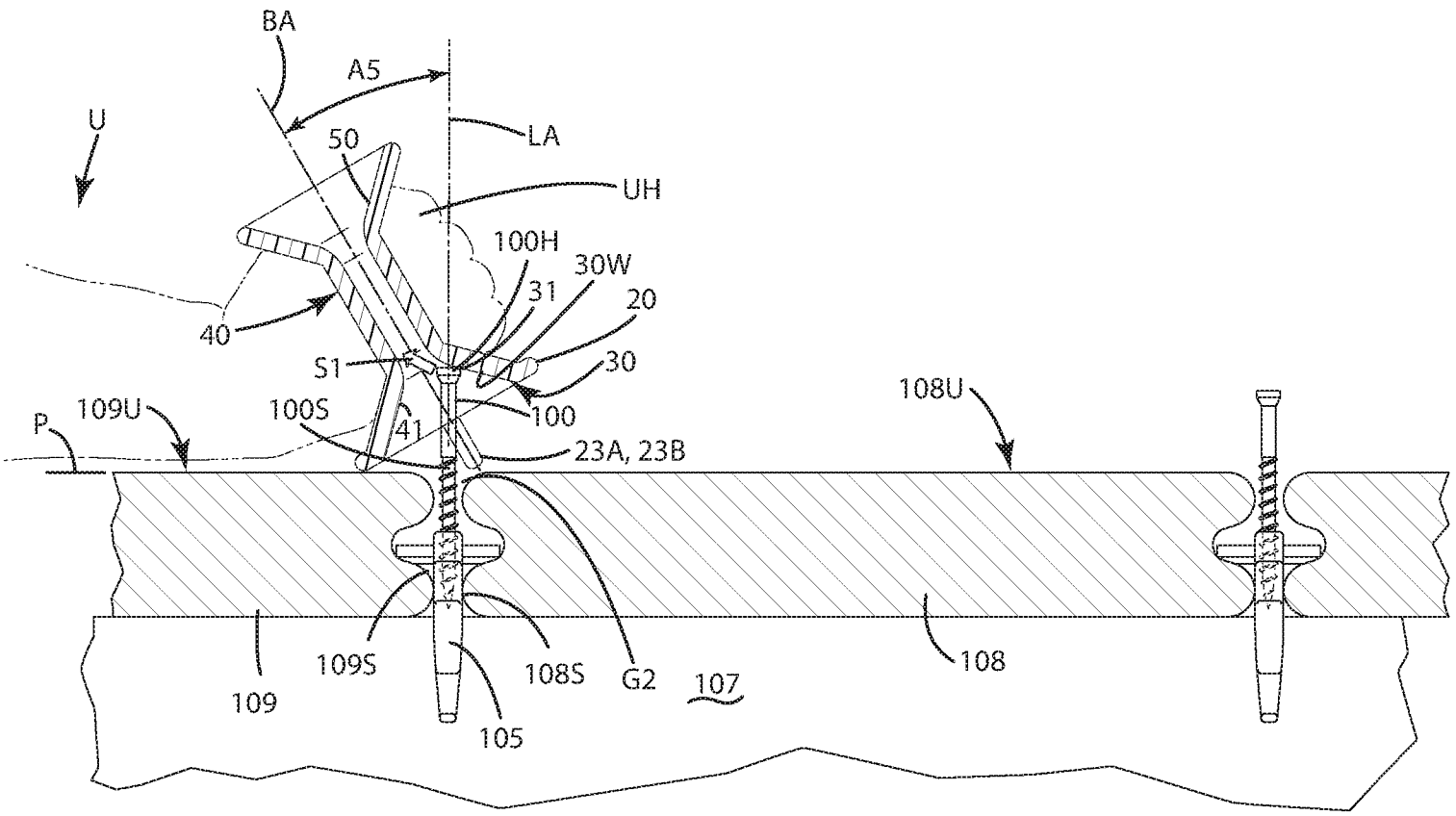
FIG. 4 is a section side view of the fastener guide being guided onto the fastener.
Figure 5:
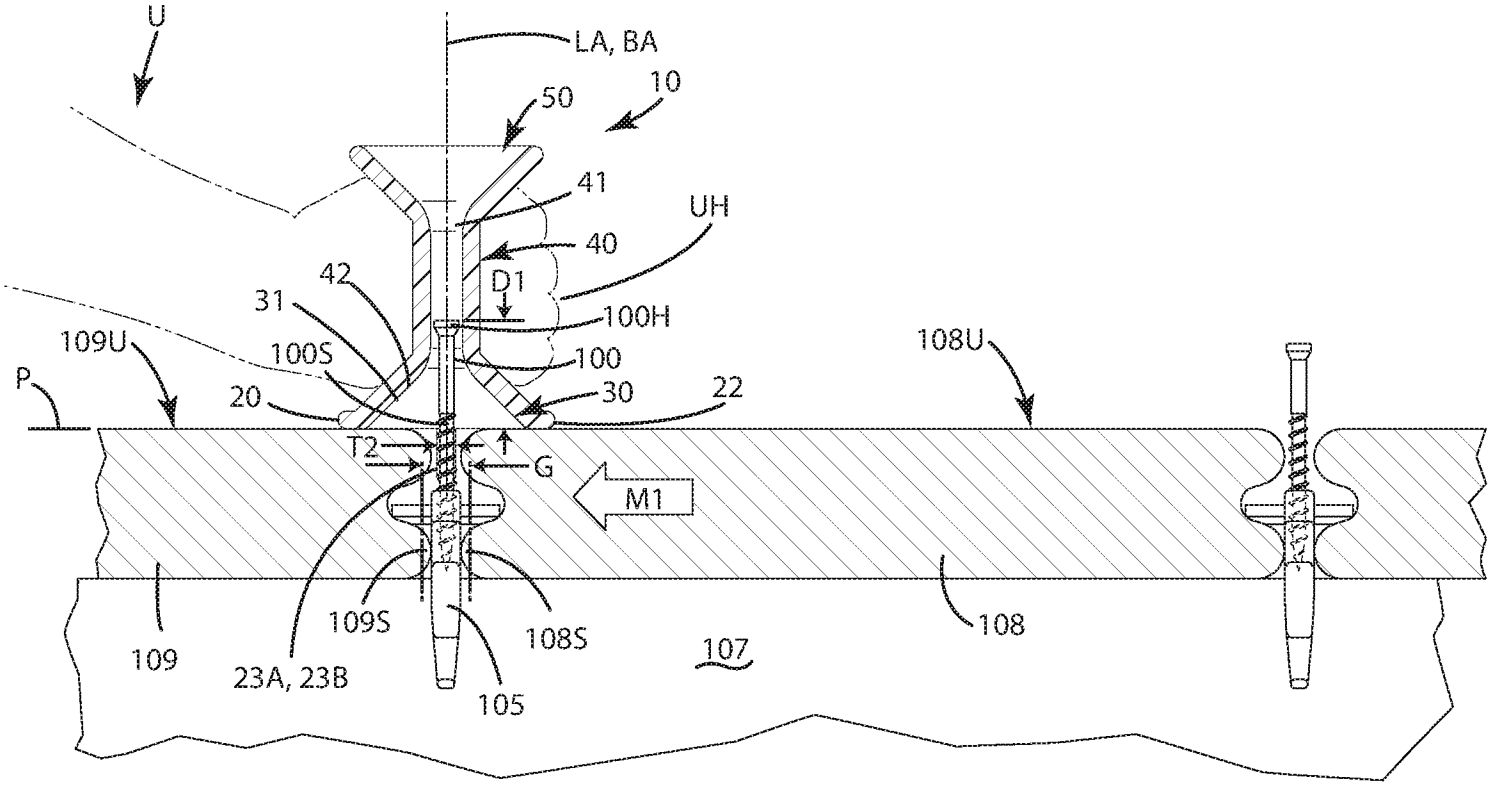
FIG. 5 is a section side view of the fastener guide installed relative to the fastener, generally maintaining the fastener in the vertical upright position and orthogonal to a plane of an upper surface of an adjacent board.
Figure 6:
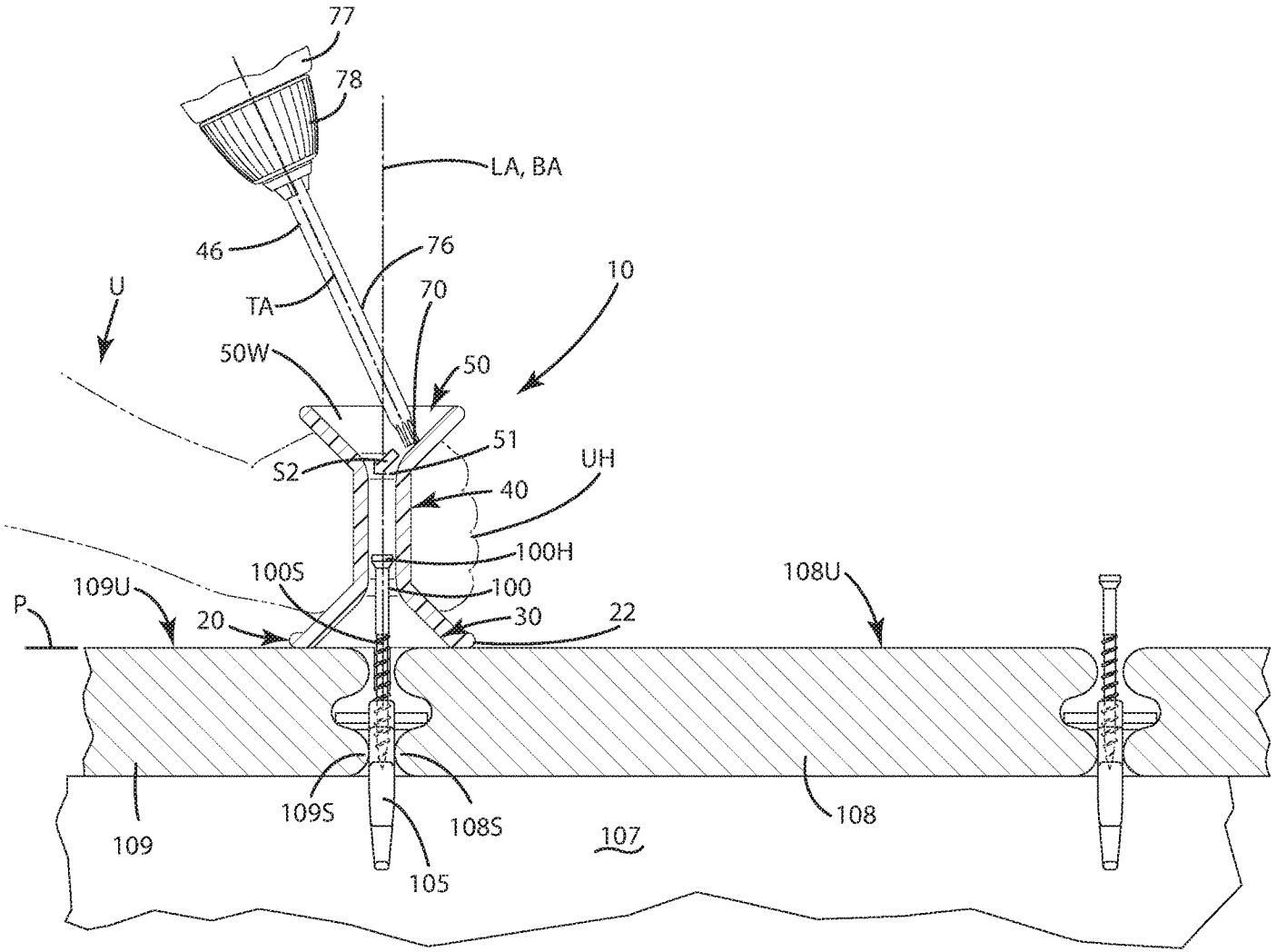
FIG. 6 is a section side view of the fastener guide installed relative to the fastener, with a drive feature being moved toward the fastener and being guided there, by the fastener guide.

A current embodiment of the fastener guide of the current embodiment is illustrated in FIGS. 1-7, and generally designated 10. The fastener guide 10 includes a base 20 having a bottom surface 22 and optionally an opposing upper surface 21. The bottom surface 22 can have one or more downward extending gap flanges 23A, 23B. These flanges can be utilized to set a gap between adjacent boards 108, 109 adjacent a fastener 100. The fastener guide 10 can include an upward extending portion 24 which extends upwardly from the base 20. The guide 10 can define a downward opening funnel 30 that is disposed above the bottom surface 22 and optionally above the gap flanges 23A and 23B. The downward opening funnel can widen or open up to a larger dimension as it extends toward the bottom surface 22 as described below. The downward opening funnel 30 can include an upper end 31 and a lower end 32. The lower end 32 can transition directly to the bottom surface 22. The upper end 31 can transition to the elongated barrel 40. The barrel 40 can be defined above the downward opening funnel which can be configured to slide over a fastener 100 and its head tools and efficiently enters the elongated barrel a predetermined distance D1 (FIG. 5). The fastener remains in the upright substantially vertical orientation relative to the upper surfaces of adjacent boards. The guide optionally can include and define an upward opening funnel 50 above the elongated barrel 40. The upward opening funnel can transition to and can be in communication with the with an upper or second opening 42 of the elongated barrel 40, that opening 42 being distal from a lower or first opening 41 of the elongated barrel 40 that is immediately adjacent and/or occupies a common space with the upper end 31 of the downward opening funnel 30. Likewise, the upward opening funnel 50 can open an upward direction away from the bottom surface 22, generally becoming a larger dimension as distance from the elongated barrel increases. The upward opening funnel 50 can be configured to enable a drive feature 70 of a drive to OL2 quickly and efficiently ride along the interior wall 53 of that funnel 50 and into the elongated barrel 40 where it registers with and engages a head tools of the fastener 100.

By utilizing the fastener guide the current embodiment, a user can quickly install the guide 10 relative to an already in position fastener 100, rotationally constrain the head 100H of the fastener 100 in the elongated barrel 40, and insert a drive feature 70 into the guide 10, with the upward opening funnel 50 guiding the drive feature 70 automatically and consistently into the elongated barrel 40, where the drive feature registers with, aligns with and engages the head 100H of the fastener 100. From there, the drive feature 70 can be rotated, thereby rotating the fastener 100 and enabling it to be advanced into an underlying workpiece 109 such that one or more workpieces 108, 109 can be secured to that underlying workpiece 109.

For purposes of illustration, the current embodiment of the fastener guide 10 is described in connection with a manual fastener guide that can be placed manually relative to a fastener 100 and that can be manually held in place above one or more boards while the drive feature 70 is guided toward and advances the fastener 100 into an underlying joist 107. The boards 108, 109 and joist 107 can be referred to as workpieces, but workpieces refer also to other types of substrates and structures, not limited to wood, composite, metal, polymeric or other types of boards or workpieces. Further, although the guide 10 is described in connection with attaching boards to a joist, generally in the construction industry, the fastener guide can be used in a variety of other applications and industries where the fastener is advanced into a substrate. In addition, the fastener described herein can be a rotatable fastener, such as a screw, having a head 100H and a shank 100S, where the shank includes one or more threads to assist in advancing and pulling the remainder of the fastener 100 into an underlying workpiece.

Generally, in the methods described herein, the fastener is already pre-located, partially installed in and held in a supported position. As illustrated, the position can be a vertical, upright position, but it is contemplated that this vertical, upright position also encompasses positions where the fastener is horizontal but otherwise held in a position relative to a vertical wall, or where the fastener is at an angle relative to a workpiece but held in place at that angle relative to the workpiece.

As described herein, the fastener can be held in the upright position utilizing a clip 105 as shown in FIG. 3. There, the clip 105 can include one or more legs 105L that assist in holding the fastener 100 adjacent and in some orientation relative to the workpiece 107 which again can be a joist. The clip can be the type and can include the features, structure and function as those clips in co-pending U.S. Provisional Application 62/545,709 to Vandenberg, filed Aug. 15, 2017, which is hereby incorporated by reference in its entirety.

As mentioned above, the fastener 100 can include a head 100H. This head can be of a dimension, such as a diameter D2 that is sized slightly smaller than a diameter D3 of the elongated barrel 40. This is so that the head 100H can consistently enter the elongated barrel 40 and slide therethrough, optionally while rotating. The diameter D3 can be slightly larger than D2, but not too large, so that the barrel rotationally constrains the head by the head rotating within and sliding along the sidewall 44 of the elongated barrel as the fastener is rotated. The head of the tool can include and/or define a drive, which optionally can be a hexalobular drive hole, a Phillips drive hole, a flat screwdriver drive hole, a hex key drive hole, a bolt head, or any other type of drive that is able to be engaged by a corresponding drive feature 70 of a tool 77.

The drive feature 70 used in conjunction with the current embodiment of the fastener guide 10 as mentioned above can take on a variety of configurations. Generally, the drive feature can be joined with and/or form a portion of an elongated bit 76. The bit can be installed in relation to the tool 77, and in particular a chuck 78 of the tool, to facilitate the securement of the bit 76 to the tool 77. The tool 77 can be an electric drill, a battery-powered drill, or any other type of tool capable of rotating a bit 76 and/or some type of drive feature 70.

The current embodiment of the fastener guide 10 as used herein is explained in connection with the installation of a particular type of fastener, although it may be utilized with a variety of other fasteners. For example, the fastener 100 as mentioned above can be attached to a clip 105. The fastener 100 can be configured to be installed adjacent one or more boards 108, 109 that lay transverse to an underlying joist 107. As an example, the boards 108, 109 can be perpendicular or otherwise transverse to the underlying joist 107 and can lay upon an upper edge of that joist 107. The upper surfaces 108U and 109U of those boards can lay in a common plane P. When placed, the fastener 100 can be orthogonal to that plane P. Of course, the clip 105 may be imperfect, or the joist 107 can be slightly warped or misshaped, in which case the fastener is not perfectly orthogonal to the plane P. In this case, where the fastener is within 1° to 10° off from being orthogonal relative to the plane, the fastener and its longitudinal axis LA is still considered to be orthogonal to the plane P.

Optionally, the fastener installed with the fastener guide 10 of the current embodiment is not installed through and does not penetrate the upper surfaces 108U, 109U of the boards. Instead, the fastener is advanced adjacent the side surfaces 108S, 109S of those boards. Those side surfaces 108S and 109S can face directly toward one another. As illustrated in FIG. 3, the side surfaces 108S, 109S can include corresponding grooves 108G, 109G. The clip 105 and/or its cleat 106 or grip element can be partially disposed in these grooves, with the assistance of the legs 105L on the joist, to support the fastener 105 in the upright, vertical configuration as shown. It is to be noted that the current embodiment is suitable for use with such an already-placed, upright and/or vertical standing, self-supported fastener (held and supported separate from the fastener guide 10). In some cases, however, instead of using a clip for this support function, the screw optionally can be partially pounded, hammered or forced slightly into a workpiece, for example, an upper surface 108U of a board. In that configuration, the fastener 100 is held in its upright, vertical orientation on its own, via its interaction with the board, rather than via a separate clip joined with the fastener.

Figure 1:
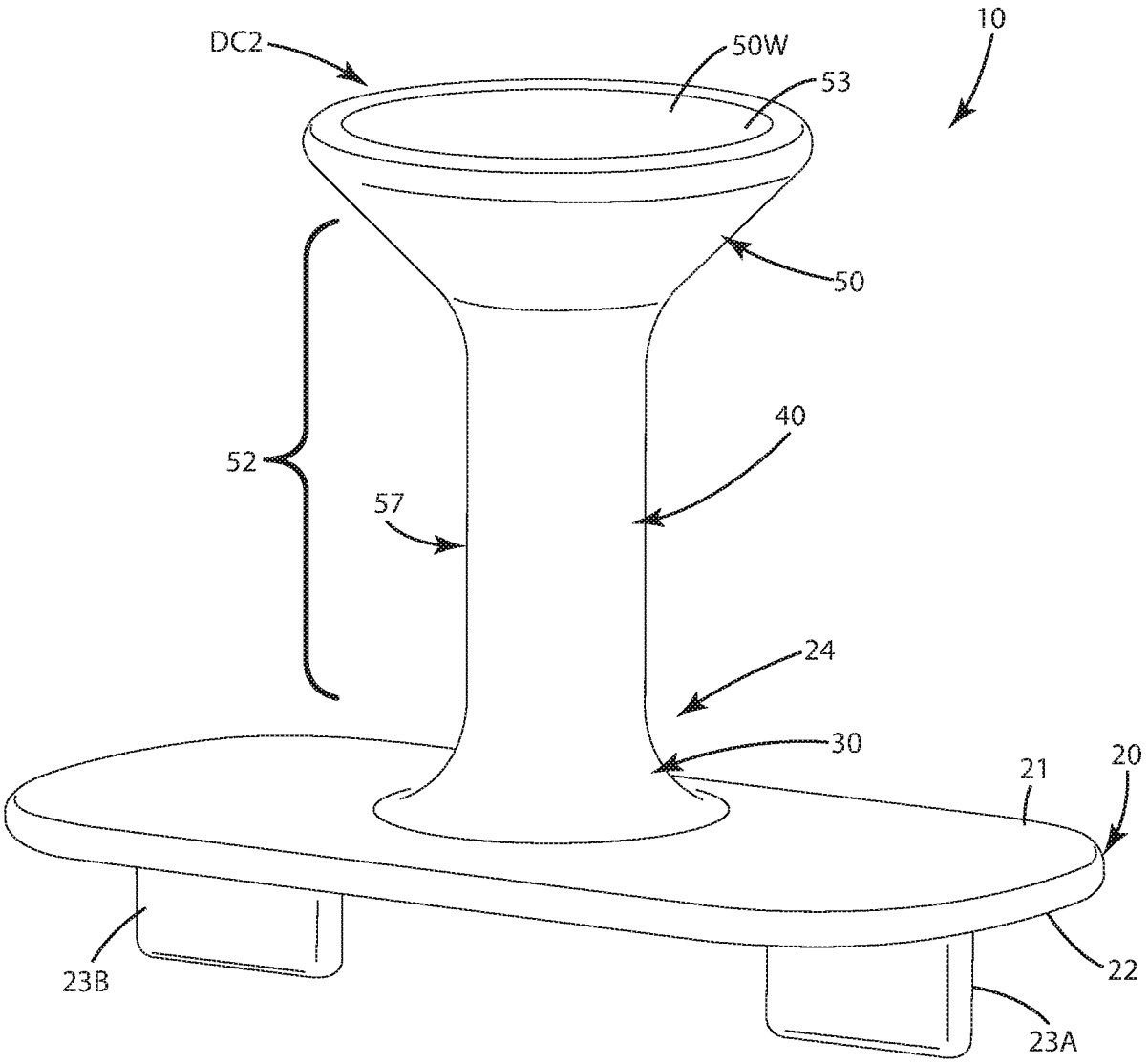
FIG. 1 is an upper perspective view of a fastener guide of a current embodiment.
Figure 2:
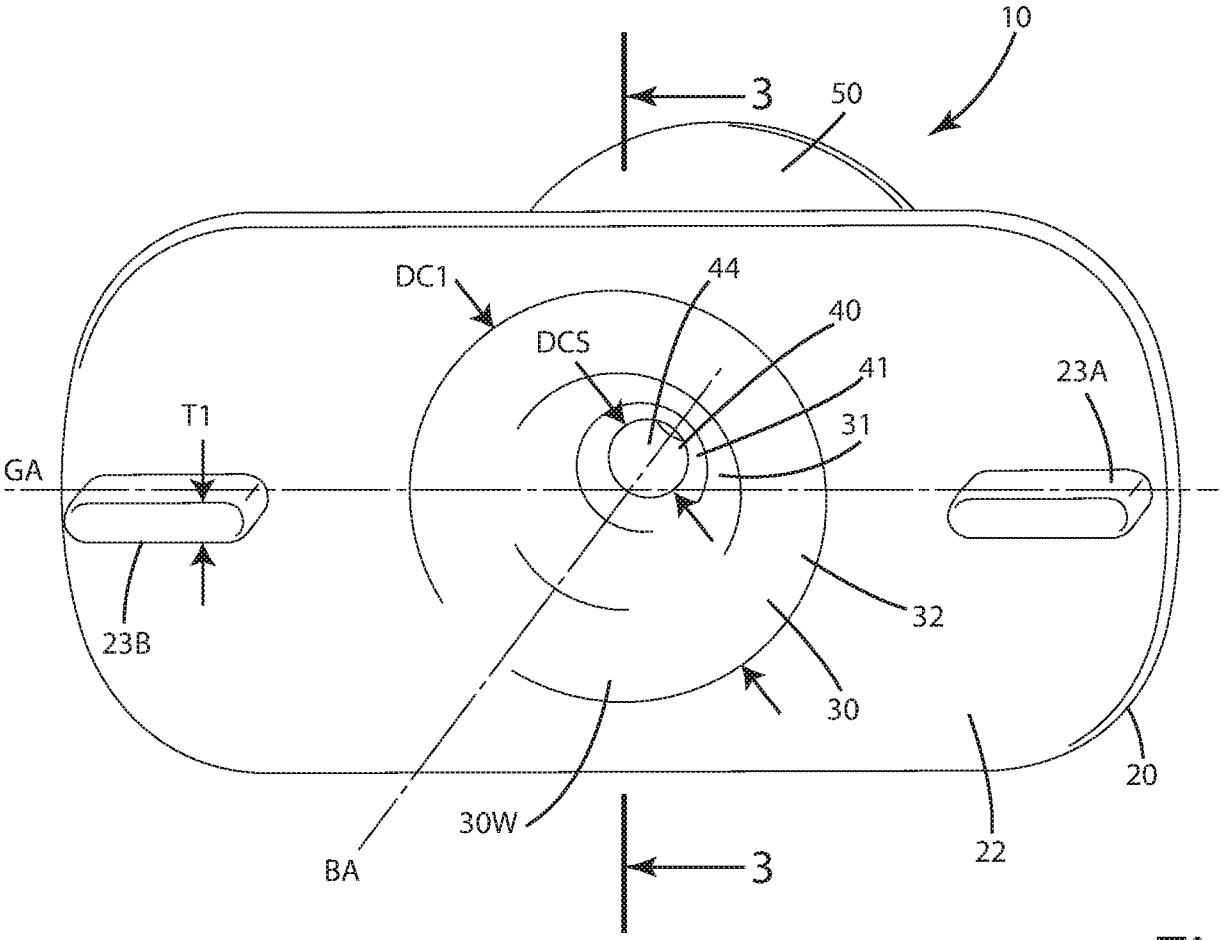
FIG. 2 is a lower perspective view of the fastener guide.

Turning now to FIGS. 1 and 2, the fastener guide 10 will be described in more detail. As mentioned above, the fastener guide 10 can include a base 20 having upper surface 21 and a bottom surface 22. The bottom surface can be substantially planar in most cases, but in others can be contoured. In some cases, the bottom surface can include a plurality of ridges or bumps to add grip and/or friction between the fastener guide 10 and an underlying board.

The bottom surface 22 can include the one or more gap flanges 23A, 23B. These gap flanges can be disposed on opposite sides of the opening 32 formed by the downward opening funnel 30. The gap flanges can be aligned along a common axis GA. That common axis GA can intersect the barrel axis BA, which is the longitudinal axis of the elongated barrel 40 of the fastener guide 10. This can be so that the fastener 100 advanced at least partially out from the barrel is disposed within a gap G (FIG. 5) that is set by the gap flanges 23A and 23B. The gap flanges can include a thickness T1 that can correspond to the final, desired gap G between adjacent boards 108, 109 and in particular between the adjacent side surfaces 108S and 109S. Indeed, after the fastener guide 10 is set in place, the boards 108, 109 can be moved toward one another, as shown in FIG. 5, in direction M1, so that side surfaces 108S and 109S engage each of the respective gap flanges on opposite sides of those flanges, compressing the flanges therebetween. With the gap G so set by the flanges and the fastener guide in general, the fastener can be advanced.

As illustrated, the gap flanges 23A and 23B can extend downward from the bottom surface 22 of the base 20. The gap flanges as illustrated are generally rectangular, of course other aesthetic designs, such as rectangular polygonal rounded or the like can be utilized as well. Further, there might only be one gap flange on one side of the barrel axis BA or funnel 30 in general, depending on the application.

With reference to FIGS. 1-2, the fastener guide 10 defines the downward opening funnel 30. This funnel can grow to a greater dimension the closer it gets to the bottom surface 22. As shown, the downward opening funnel 30 can be cone or frustoconical shaped. Where cone shaped, the diameter DC of the cone can decrease, taper or become less as the cone transitions toward the elongated barrel 40. Of course, the funnel 30 need not be perfectly cone-shaped. The inside of the funnel can be slightly rounded and/or spherical. The funnel can also include an interior wall 30W. This wall 30W can be generally smooth and/or featureless, optionally without any ridges, ribs or other pointed or edgy contours that can impair the sliding or movement of that wall along the generally stationary head or other portion of the fastener 100 so that the head can enter the elongated barrel 40. In other constructions, the funnel interior wall 30 can include ribs, ridges and/or recesses that generally point toward the upper end 31 or the opening 41 of the elongated barrel 40.

The funnel 30 can be constructed so that the smallest diameter DCS of the funnel, near the upper end 31 of the funnel, is larger than the diameter D2 of the head 100H of the fastener 100. This is so that the head 100H can enter the elongated barrel 40 through the end 31 or opening 41, generally above the upper end without being impaired by surfaces of the downward opening funnel 30. This diameter DCS of the funnel 30 can be substantially equal to or slightly greater than the diameter D3 of the elongated bore 40 in some applications.

The downward opening funnel 30 mentioned above transitions to the elongated barrel 40. As shown in FIGS. 1-3, the elongated barrel 40 can extend from the upper end 31 of the downward opening funnel 30 to the lower end 51 of the upward opening funnel 50. The elongated barrel can include an interior wall 44 as described above. This wall can be cylindrical or some other shape that enables and facilitates linear sliding and rotation of the head within the elongated barrel. Generally, the elongated barrel 40 can include a lower opening 41 and an upper opening 42. The lower opening 41 can be in communication with and can transition to the upper end 31 of the downward opening funnel 30. The upper opening 42 can be in communication with and transition to the lower end 52 of the upward opening funnel 50. The lower end 52 can be distal from and opposite the upper end 51 of the upward opening funnel 50.

The elongated barrel 40 can be substantially tubular and can have a uniform diameter D3. Again this uniform diameter D3 can be sufficient to engage the outer perimeter of a head 100H of fastener 100 as the fastener rotates therein. It can be slightly larger so that the head tools generally rotates about the barrel axis BA, and simultaneously about a longitudinal axis LA of the fastener which is substantially coincident with and parallel to the barrel axis BA. The barrel 40 can be set a predetermined distance D1 above the bottom surface 22 of the base 20, generally above the upper end 31 of the downward opening funnel 30. This distance D1 can be set so that the fastener head 100H (FIG. 5) is located substantially within the elongated barrel 40 when the bottom surface 22 engages in upper surface 108U, 109U of the adjacent boards 108, 109. The shaft 100S of the fastener 100 also can be at least partially within the elongated barrel 40 upon placement of the fastener guide 10 on the board upper surfaces. In some cases, optionally at least ⅛, further optionally at least ¼, even further optionally at least ½ the length of the fastener 100 can be disposed in the elongated barrel 40 when the bottom surface 22 of the base 20 engages the upper surfaces of the boards. Further, in this configuration, the shaft 100S can be disposed at least partially in the elongated barrel, above the upper end 31 and/or the opening 41, while another lower portion of the shaft 100S is disposed in the downward opening funnel, and yet another portion of the shaft 100S is disposed below the bottom surface 22 of the base, generally between the side surfaces 108S and 109S of the adjacent boards 108, 109 respectively.

With reference to FIGS. 1 and 5, the elongated barrel 40 transitions to the upward opening funnel 50. The upward opening funnel 50 includes an interior wall 50W which can be similar to the wall of the downward opening funnel, but facing and opening the opposite direction. Optionally, the interior wall 50W and funnel 50 in general can be cone-shaped, becoming larger in dimension further there from the base 20. Further optionally, the upward opening funnel and the downward opening funnel can be substantially the same in dimension from top to bottom, however, as illustrated, the contour of the respective interior walls differs, with the upward opening funnel being taller in height than the downward opening funnel. Of course, this can be altered depending on the application and the types of fasteners used during an installation process.

As shown in FIGS. 1 and 2, the elongated barrel 40, the downward opening funnel 30 and the upper opening funnel 50 can be reflected in outer or exterior surface 57 of the fastener guide 10. These various components and the respective exterior surfaces thereof can cooperatively form a grasping region 58 about which a user can manually grasp and manipulate the fastener guide 10. With this grasping region, the user can wrap one or more digits around the exterior surface of the barrel 40, and around at least a portion of the upward opening funnel and the downward opening funnel. The grasping region 58 can terminate below the upper opening 52 of the upward opening funnel 50, and can terminate at the upper surface 21 of the base 20. Of course, the grasping region can be altered in shape and contour for a particular application or an orientation of holding for the fastener guide 10.

A method of using the fastener guide to install a fastener will now be described in further detail with reference to FIGS. 1-7. To use the guide 10, a user U grasps with the user's hand UH the guide 10. This can be done by the user wrapping their digits about the grasping region 58 of the guide, generally between the base 20 and the outwardly projecting portion of the upward opening funnel 50. The user can utilize the guide in connection with a fastener 100 that is already supported separately in an upright, vertical orientation as illustrated in FIG. 3. There, the longitudinal axis LA of the fastener 100 is substantially vertical. The fastener 100 can be held in this substantially vertical orientation via a clip 105 that is joined with a joist 107 underlying the one or more boards 109 and 108. The legs 105L of the clip 105 can extend downwardly, adjacent opposite sides of the joist 107, thereby holding the clip 105 in an upward position, along with the fastener 100. The clip can include one or more cleats 106 that engage grooves 108G and 109G of the respective boards that are placed adjacent one another. The clip 105 is positioned between the side surfaces 108S and 109S of those boards. The fastener 100 and thus its shaft 100S and its head 100H are placed adjacent and generally between the side surfaces of the boards, and the boards themselves. The fastener projects upwardly from a gap G2 that is initially established between the adjacent side surfaces 108G and 109G of the boards. The fastener 100 and longitudinal axis LA thereof generally project vertically and orthogonal relative to a plane P that can pass through the upper surfaces 108U and 109U of the boards 108 and 109. Sometimes, however, the longitudinal axis LA is not perfectly orthogonal, for example, it can be about 1° to 10° offset from being orthogonal to the plane P, and yet it is still considered orthogonal herein. Likewise, the longitudinal axis can generally be about 1° to 10° offset from vertical and yet still be considered vertical herein.

As the user U advances the guide 10 toward the fastener 100 and in particular the head 100H, the barrel axis BA can be offset at some angle A4 relative to the longitudinal axis LA of the fastener. The user can continue to advance the base 20 and the bottom surface 22 toward the upper surfaces 108U and 109U of the boards. During this movement, as shown in comparing FIGS. 3 and 4, the angle A4 can change to another different angle A5. Of course, the angle A or the longitudinal axis LA relative to the barrel axis BA can vary considerably during this progression of the base 20 toward the upper surfaces of the boards 108U and 109U.

Eventually, the base 20 can come into close proximity to the upper surfaces of the boards. As it nears the upper surfaces, as shown in FIG. 4, the head 100H of the fastener 100 can engage the downward opening funnel 30 and in particular the sidewall or interior wall 30W thereof. When the fastener engages the sidewall 30W, it can slide along the generally featureless, smooth wall, being funneled and conveyed generally toward the upper and 31 of the downward opening funnel and the elongated barrel 40. This movement is indicated by the arrow S1 in FIG. 4. The head continues to slide along the wall until it passes the upper and 31 and generally through the lower opening 41 of the elongated barrel 40. The head continues to slide through the opening and into the elongated barrel. During this advancement, the gap flanges 23A and 23B can begin to enter the gap G2 between the side surfaces 108S and 109S of adjacent boards, generally over the portions of the clip 105 and beside the shaft 100S of the fastener 100. These flanges can eventually enter the gap G2.

During this movement of the fastener guide 10, the barrel axis BA also becomes more substantially aligned and optionally parallel to the longitudinal axis LA of the fastener. The head 100H of the fastener also can slide within and relative to the interior wall 44 of the elongated barrel 40 upward, in that elongated barrel, a preselected distance D1. Optionally, when the bottom surface of the base 20 engages the upper surfaces of the boards, this orients the longitudinal axis or barrel axis BA of the elongated barrel orthogonal to the plane P that is parallel to the upper surface of the board. It also aligns the barrel axis BA essentially parallel to the longitudinal axis LA of the fastener 100.

As shown in FIG. 5, the fastener guide 10 is installed with the fastener inside the guide 10. The base 20 and its bottom surface 22 rest against the upper surfaces 108U and 109U of the respective boards 108, 109. The gap flanges 23A, 23B are between the side surfaces 1085 and 109S of the boards. The longitudinal axis LA of the fastener and the barrel axis BA are substantially aligned in parallel with one another as illustrated. Due to the resting of the bottom surface 2 on the upper surfaces of the boards, the fastener and longitudinal axis are held in an upright and vertical orientation adjacent the side surfaces of the respective boards. The fastener also can be substantially orthogonal to the plane P that passes through the upper surfaces of the boards.

With the gap flanges 23A, 23B in place, between the side surfaces of the boards, and adjacent the clip, one or more of the boards can be moved in direction M1 toward the other board so that the flanges 23A, 23B are pinched between the side surfaces 108S, 109S. Thus, the gap G attains the same dimension as the thickness T1 of the flanges 23A and 23B. This occurs while the base 20 remains atop the upper surfaces 108U, 109U of the boards. The fastener 100 also is held securely in place, and in the upright, vertical orientation by virtue of the head 100H being disposed in the elongated barrel 40. In this position, as mentioned above, the head 100H can be located substantially within the elongated barrel, above the upper end 31 of the downward opening funnel 30. The shaft 100S also can be at least partially within the elongated barrel 40, extending through the downward opening funnel 30, and generally disposed within the gap between the adjacent side surfaces of the boards. In addition, the shaft can be disposed between the flanges 23A and 23B.

With the boards properly positioned adjacent one another, being gapped by the optional flanges 23A and 23B, and the fastener 100 in the upright vertical orientation, the fastener can be advanced into the underlying joist 107 to secure the boards. In particular, with reference to FIG. 6, the user U can hold the fastener guide 10 in place, and can advance a tool 77 toward the fastener head 100H. The fastener guide facilitates this immensely. As shown, the user U can advance the drive feature 70 toward and into the upward opening funnel 50, generally past the upper end 52 thereof, toward the lower end 51 thereof. In so doing, the drive feature can engage the interior wall 50W of the upward opening funnel. Because the drive feature need only enter the large dimensioned upper end 52 of the funnel, it is easier for the user to align that small drive feature and place it into that funnel. When the drive feature 70 engages the interior wall 50W, it slides in direction S2 toward the elongated barrel 40. The tool axis TA initially can be misaligned by an angle A6 offset from the barrel axis and longitudinal axis LA of the fastener. Again, this angle can vary depending on the orientation of the tool 77. The user can then allow the drive feature 70 to slide along the funnel and through the lower end 51 of the funnel, directly into the elongated barrel 40. This occurs while the base 20 remains engaged with the upper surfaces of the board and the fastener is held in the upright, vertical position, optionally orthogonal to the plane P.

Figure 7:
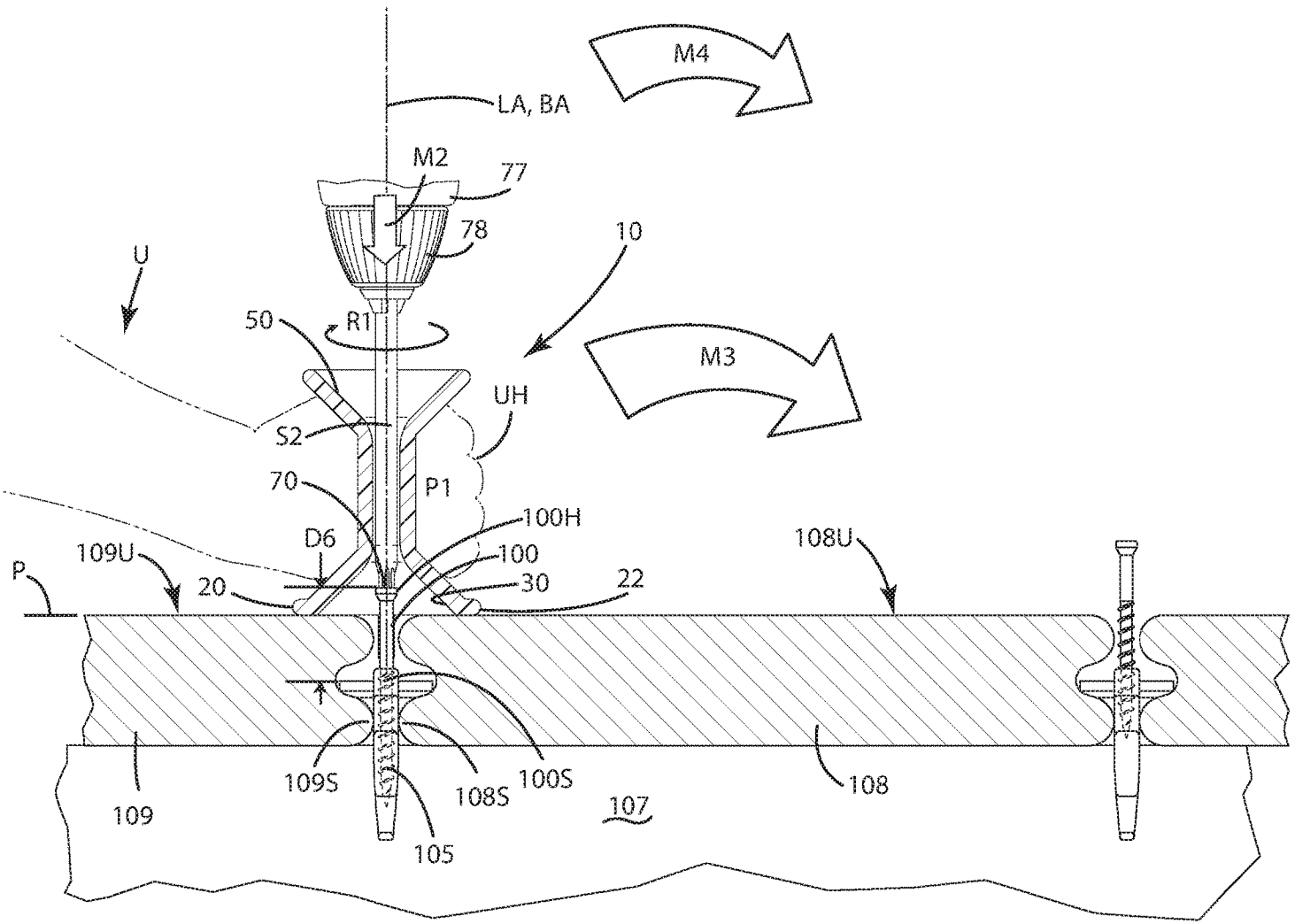
FIG. 7 is a section side view of the fastener guide installed relative to the fastener, with a drive feature engaging and advancing the fastener within the fastener guide.
Figure 8:
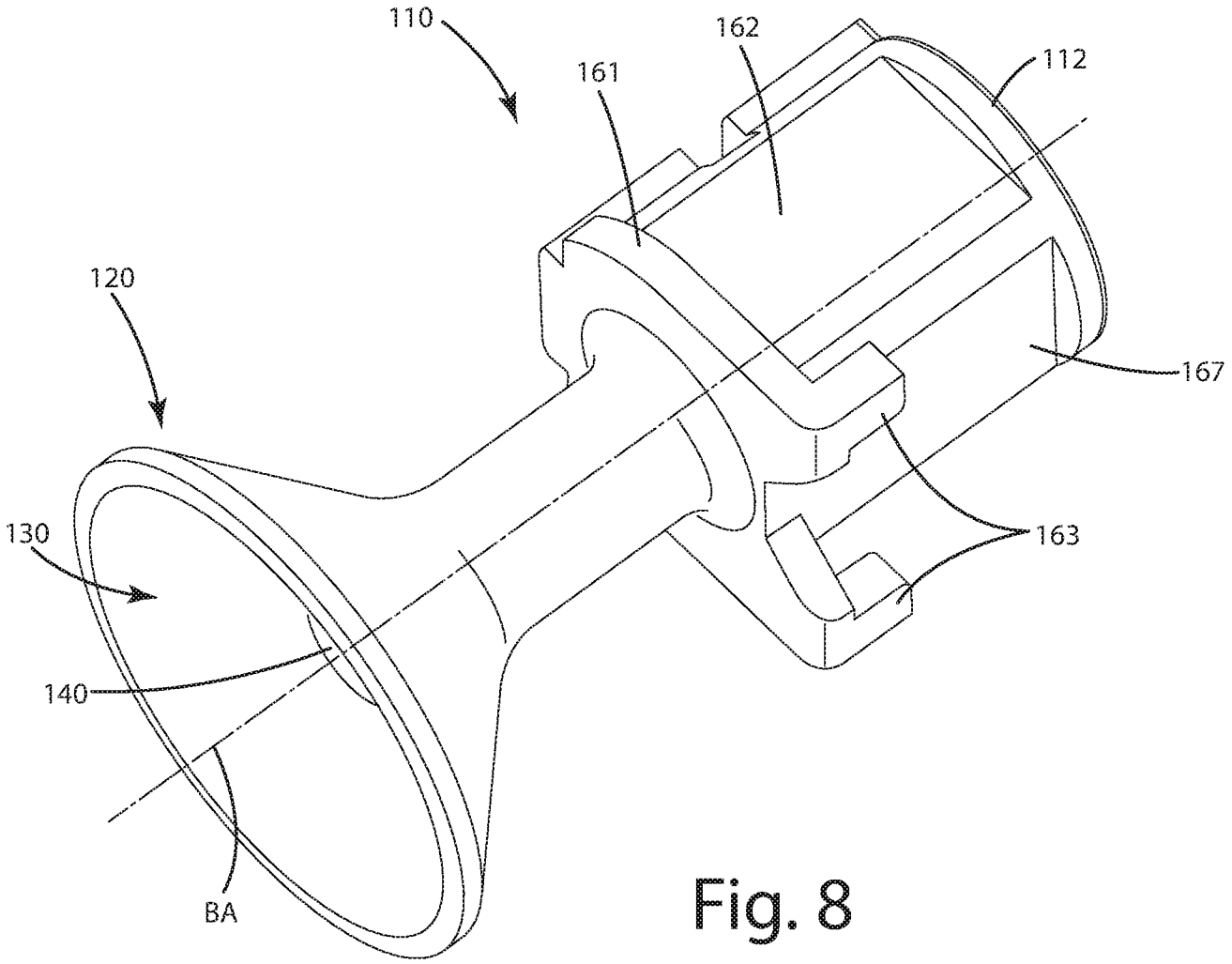
FIG. 8 is a perspective view of a first alternative embodiment of the fastener guide configured for attachment to a nose of an automatic fastener driving tool.

The advancement of the drive feature 70 can continue, and the drive feature 70 and its axis TA can become aligned with the longitudinal axis LA of the fastener and the barrel axis BA of the barrel 40 as shown in FIG. 7. There, the drive feature 70 can register with, or otherwise be joined with the head 100H the fastener 100 that remains disposed between and adjacent the side surfaces 108S and 109S of the boards. With the drive feature registered and aligned with the head 100H, the drive feature and the head are generally rotationally constrained in the elongated barrel 40. The user U can then apply rotational moment or force R1 to the drive feature 70 which turns the head 100H and the fastener 100. The fastener 100, fastener head and the drive feature 70 remain rotationally constrained in the elongated barrel as they rotate. The user can push downward on the tool 77, moving it direction M2, while the drive feature rotates in direction R1, generally while the tool axis, longitudinal axis of the fastener, and the barrel axis are aligned and in parallel.

The drive feature 70 advances in the barrel 40, rotating and engaging the head and rotating the fastener. During the engagement of the head of the fastener with a drive feature, the fastener can begin to bite into and move or advance into the joist 107. The drive feature 70 continues to engage the head during this advancing. The head and drive feature 70 pass through the barrel 40 and through the upper end 31 of the downward opening funnel 30. At some point, the head passes into the downward opening funnel 30 before the drive feature enters the downward opening funnel. The drive feature 70 and its associated bit 76 still remain rotationally constrained by the barrel 40, rotating in direction R1 in that barrel. When the fastener, and in particular the head 100H, enter the downward opening funnel 30, the fastener 100 is no longer rotationally constrained in the elongated barrel. The drive feature, associated with the bit 76, however remains rotationally constrained. The fastener is thus guided by the advancement of the drive feature, guided by the elongated barrel, downward into the underlying joist 107. The fastener continues to be advanced by the drive feature.

As this occurs, the drive feature and the head pass below the upper surfaces 108U, 109U of the boards. The head and drive feature 70 also pass adjacent the side surfaces 108S, 109S of the boards. The head 100H moves downward adjacent the side surfaces 108S, 109S of the boards to engage a cleat 106 of the clip 105. The fastener 100 moves downward thus a predetermined distance D6 until the head engages the cleat 106. As the head 100H engages the cleat 106, draws that cleat downward toward the joist 107, thereby pulling the boards 108 and 109 into further securement with that underlying joist.

After the fastener 100 is sufficiently installed as shown broken lines in FIG. 7, the user can withdraw the drive feature 70 from the fastener guide 10. As the user does this, the drive feature disengages the head 100H. The drive feature 70 thus passes upward in the barrel moving along the barrel axis BA. The drive feature can be withdrawn through the downward opening funnel 30, through the elongated barrel 40 and optionally out the upward opening funnel 50. In some cases, the user can elect to leave the drive feature in the elongated barrel as the user transfers the fastener guide 10 in direction M3 toward the next fastener 102 to be installed. In other cases, the user can completely withdraw the drive feature from the fastener guide 10 and separately move the tool with the drive feature attached to it in direction M4, such that the drive feature 70 again enters the fastener guide 10 in a manner similar to that above, with altering angles of the tool axis TA relative to the longitudinal axis LA of the fastener and the barrel axis BA. The user can continue to utilize the fastener guide 10 to install multiple upright, vertical fasteners relative to boards to secure those boards in place.

A first alternative embodiment of the fastener guide is illustrated in FIGS. 8- 14 and generally designated 110. The fastener guide 110 can be similar to the fastener guide 10 described above in structure, function and operation, with several exceptions. For example, the fastener guide 110 can be configured to be permanently or at least temporarily secured to an automatic, fastener installation tool 177. This installation tool 177 can be referred to as a standup tool and can be operated by user standing upon two legs and advancing the tool and the guide 110 toward a fastener 200 which can be at least partially installed in a board 208. For example, the fastener can be partially installed with its tip 200T embedded the upper surface 208U of the board 208U. In this application, the fastener is not held in the upright vertical position with a clip. Incidentally, the fastener guide 10 described above also can be utilized in conjunction with this type of partially installed fastener 200, and a variety of other fasteners held in upright and/or vertical orientations generally.

Returning to FIGS. 8-9, the fastener guide 110 can include a base 120 and can define a downward opening funnel 130 in communication with an elongated barrel 140. These features and their corresponding structures can be substantially similar to that of the embodiment of the guide 10 described above and therefore will not be described again in detail here. In this case, however, the upward opening funnel can be deleted. This feature can be deleted because the fastener guide 110 can precisely and consistently be mounted relative to the tool 177, so that the tool axis TA, which extends in the direction that the drive feature 170 is guided, is substantially parallel to and aligned with the barrel axis BA. Thus, these elements and axes remain aligned with one another without having to cause such alignment via an upward opening funnel.

Figure 9:
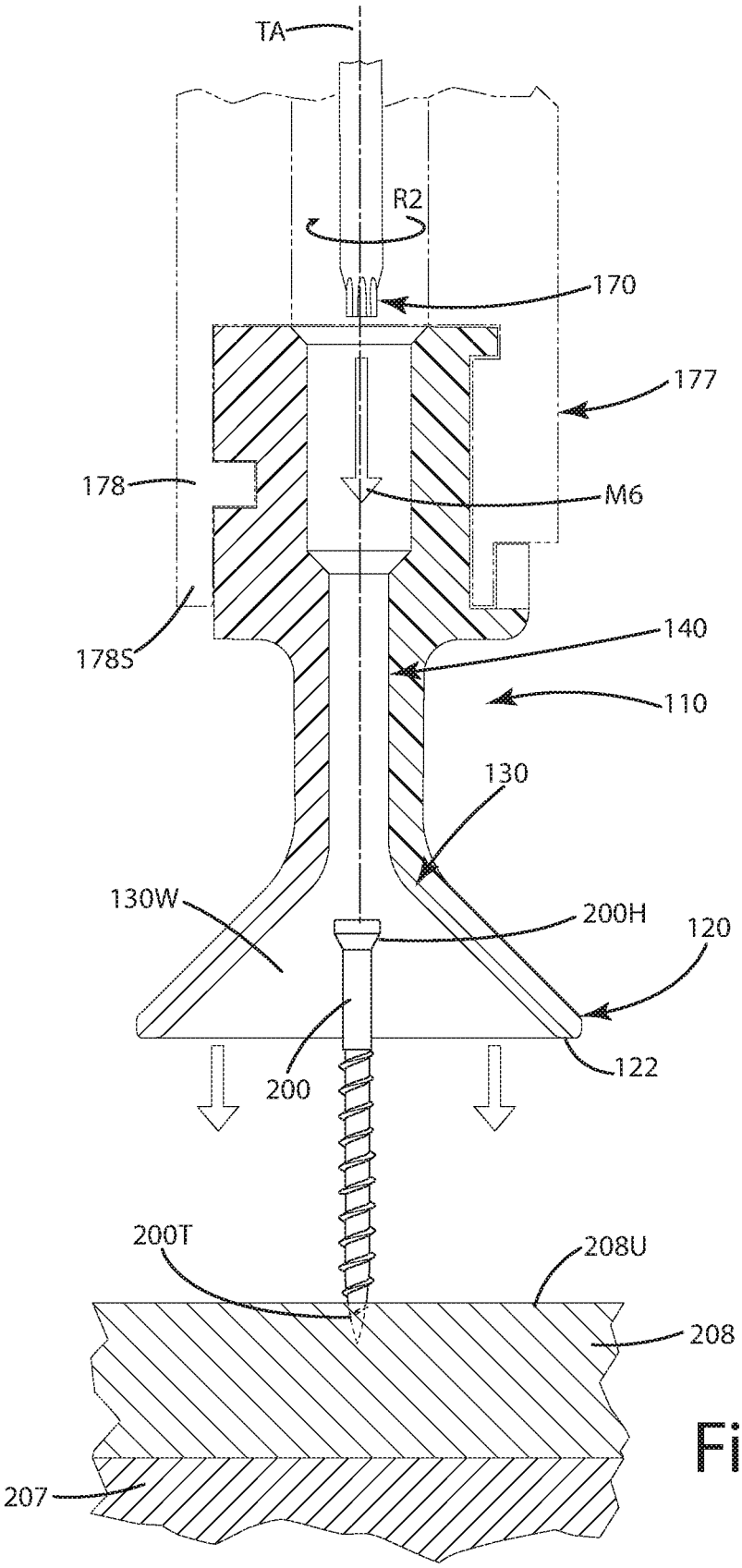
FIG. 9 is a section side view of the fastener guide of the first alternative embodiment, installed on an automatic fastener driving tool, about to engage a fastener supported separate from the guide in an upright, vertical position.
Figure 10:
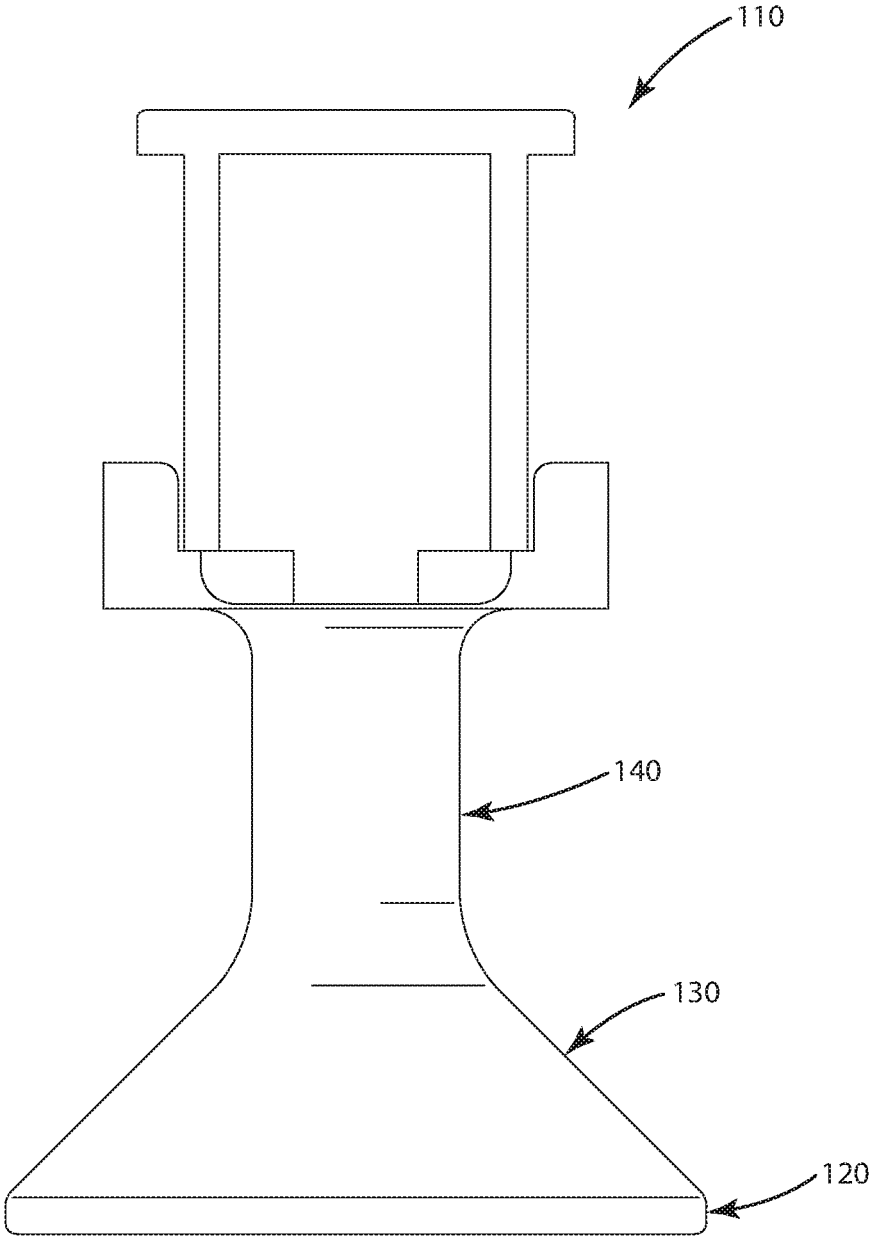
FIG. 10 is a front view of the fastener guide of the first alternative embodiment.
Figure 11:
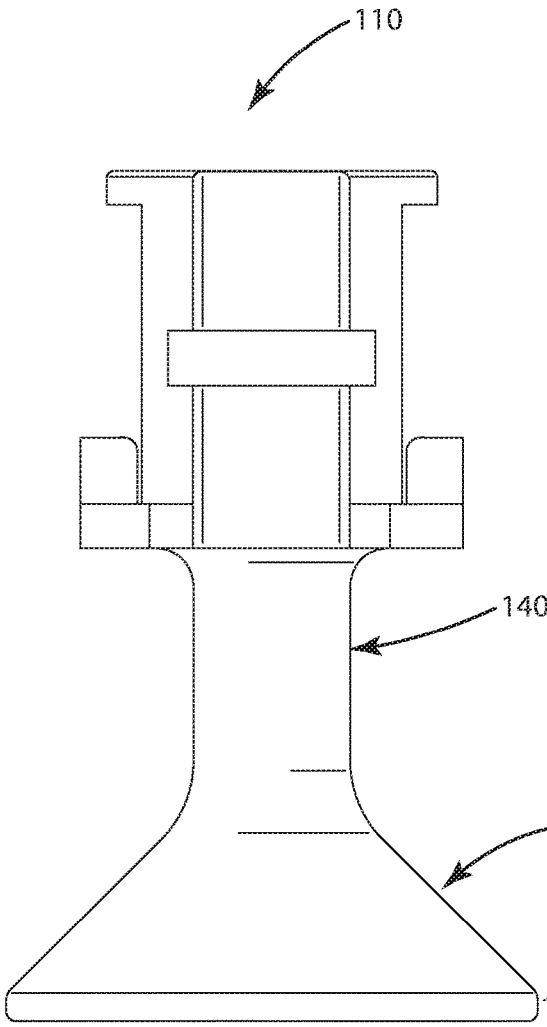
FIG. 11 is a rear view thereof.
Figure 12:
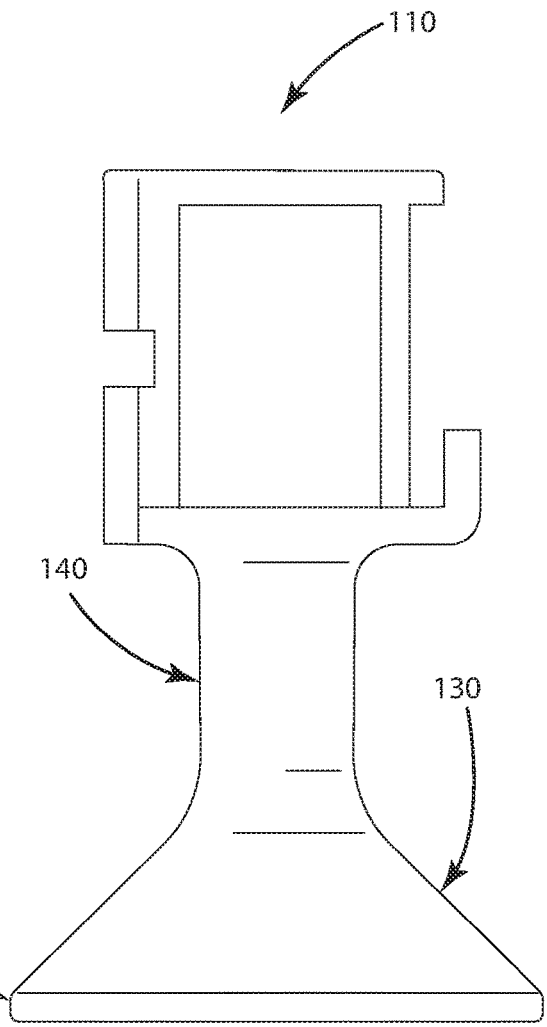
FIG. 12 is a right side view thereof, the left side view being a mirror image thereof
Figure 13:
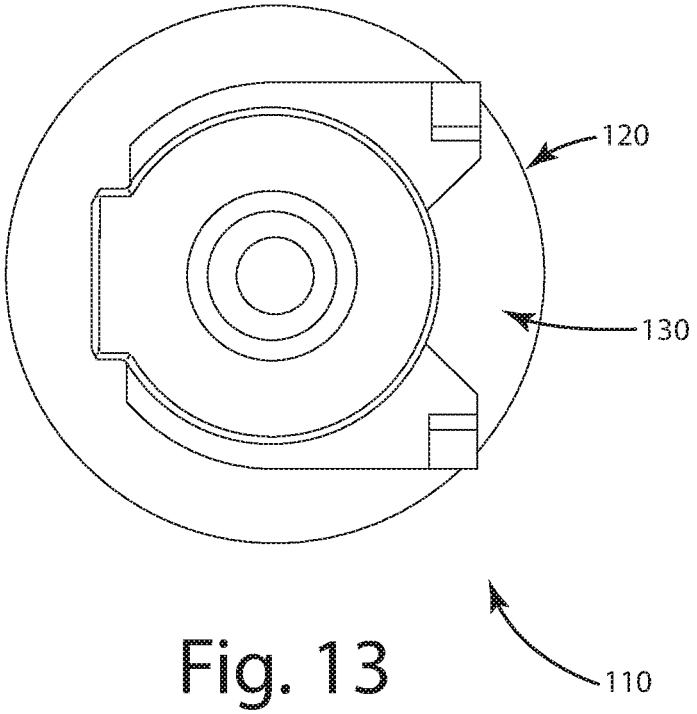
FIG. 13 is a top view thereof.
Figure 14:
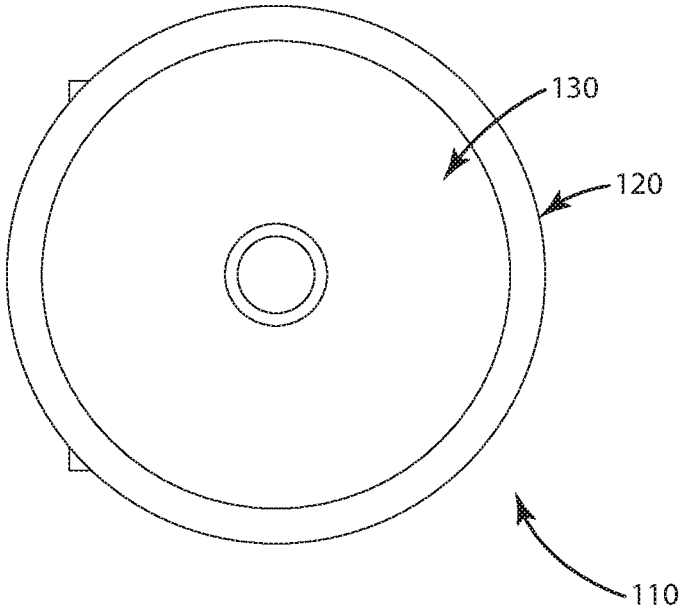
FIG. 14 is a bottom view thereof.

This fastener guide 110 can include a ring 161 that engages a shoulder 171S of the tool 177 and in particular a nose 178 of the tool. The fastener guide 110 can include one or more registration features. For example, it can include anti-rotation flats 162 that prevent the fastener guide 110 from rotating relative to the nose 178. The fastener guide also can include a groove 167 which can align the guide with the nose 178. The guide 110 can include one or more mounting elements, such as the mounting arms 163 that project upward, toward the second end 112 of the guide 110. These mounting arms 163 can assist in mounting and securing the guide 110 to the nose 178 as shown in FIG. 9.

The method of using the fastener guide 110 associated with the stand-up, automatic tool 177 is similar to that of using the guide manual guide 10 described above. Generally, a user can move the guide 110 toward a fastener 200 having a head 200H. The head 200H can move along an interior side wall 30W of the downward opening funnel 130 until the head 200H enters the elongated barrel 140. The user can know that this occurs when the bottom surface 122 of the base 120 engages the upper surface 208U of board 208. The user can engage the drive element 170, moving it in a direction M6 toward the head 200H to engage the head. As this occurs, the drive element 170 can rotate in direction R2 to rotate the fastener 200 so that advances into the board 208, optionally securing it to the underlying board 207.

A second alternative embodiment of the fastener guide is illustrated in FIGS. 15-18 and generally designated 210. The fastener guide 210 can be similar to the fastener guides 10 and 110 described above in structure, function and operation, with several exceptions. For example, the fastener guide 210 can be configured to be secured to an automatic, fastener installation tool 277, for example, via a bit 276. This installation tool 277 can be referred to as a hand held tool and can be operated by user standing or kneeling upon two legs. Optionally, the tool 277 can be an electric drill, a battery-powered drill, or any other type of tool capable of rotating a bit 276 and/or some type of drive feature 270 associated with the fastener 300 and its head 300H. The drive feature of the bit can include and/or define a drive, which optionally can be a hexalobular drive, a Phillips drive, a flat screwdriver drive, a hex key drive, a socket, or any other type of drive that is able to engage a corresponding drive feature of the fastener 300, and in particular the fastener head 300H.

The drive feature 270 can be joined with and/or form a portion of the elongated bit 276. The bit can be installed in relation to the tool 277, and in particular a chuck 278 of the tool, to facilitate the securement of the bit 276 to the tool 277. The bit 276 can define an annular groove or recess 276G distal from the drive feature 270. The groove can be concave and rounded as illustrated, or can be rectangular, triangular or of other shapes, depending on its interface with the fastener guide 210, and in particular a retaining or retention ring 279R as described below. The bit also can include a second groove 278G, which can be configured interface with the chuck 278 of the power tool 277. Generally, the fastener guide 210 of this embodiment is constructed to be attached directly to a power tool. With this attachment directly to the power tool, the fastener guide 210 can be oriented and manipulated relative to a fastener to be installed by moving the power tool around in various orientations relative to that fastener. Alignment of the fastener guide and the fastener can be performed largely by moving the power tool around, without significant manual manipulation of the fastener guide itself by a user. Of course, a user can grasp a portion of the fastener guide 210 to steady it, or to move it relative to a fastener to be installed. It also is to be noted that the components of the fastener guide 210, while being joined with the bit 276, can break free from the rotation of that bit while it is being rotated by the power tool 277 so as not to injure a user that manually grasps the components of the fastener guide 210.

The guide 210 and the associated tool can be used to advance a fastener associated with a clip that holds the fastener in an upright vertical position as described in the first embodiment above, or to advance a fastener which can be at least partially installed in a board, as described in connection with the other embodiment above. For example, the fastener can be partially installed with its tip embedded in the upper surface of a board. In this application, the fastener might not be held in the upright vertical position with a clip. Incidentally, the fastener guide 210 described here can be utilized with this type of partially installed fastener, and a variety of other fasteners held in upright and/or vertical orientations generally.

Returning to FIGS. 15-18, the fastener guide 210 can include a base 220 that is formed from a lower portion of a downward opening funnel 230 in communication with an elongated barrel 240. These features and their corresponding structures can be substantially similar to that of the embodiment of the guide 10 described above and therefore will not be described again in substantial detail here along with their respective components. Suffice it to say that the downward opening funnel 230 can form a void in which optionally can be in the shape of a cone like that of the embodiments above. The upper end of the downward opening funnel can transition to the elongated barrel and can share a common opening. The bore 245 of the elongated barrel 240 can transition to the inner surfaces of the downward opening funnel. The downward opening funnel also can include a lowermost engagement surface 222 configured to engage a board during a fastener driving operation as described below. In this embodiment, the upward opening funnel of the embodiment described first above can be absent, along with the flanges and the grasping area on the elongated barrel for a user to grasp. This embodiment can be constructed for direct attachment to the power tool, without the need to grasp the guide 210 in a user's hand and thereby align it with a fastener.

Figure 15:
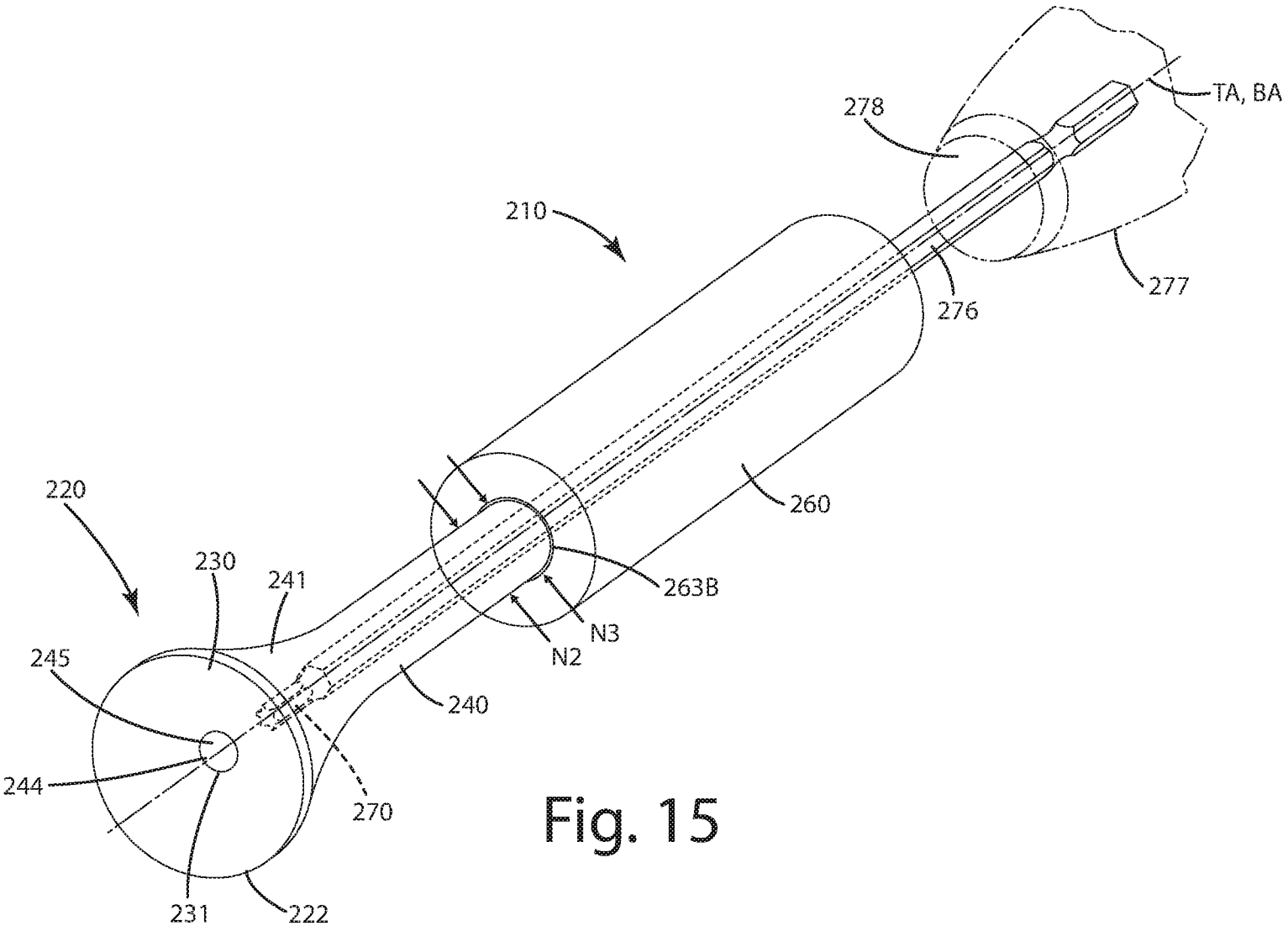
FIG. 15 is a perspective view of a fastener guide of a second alternative embodiment.
Figure 16:
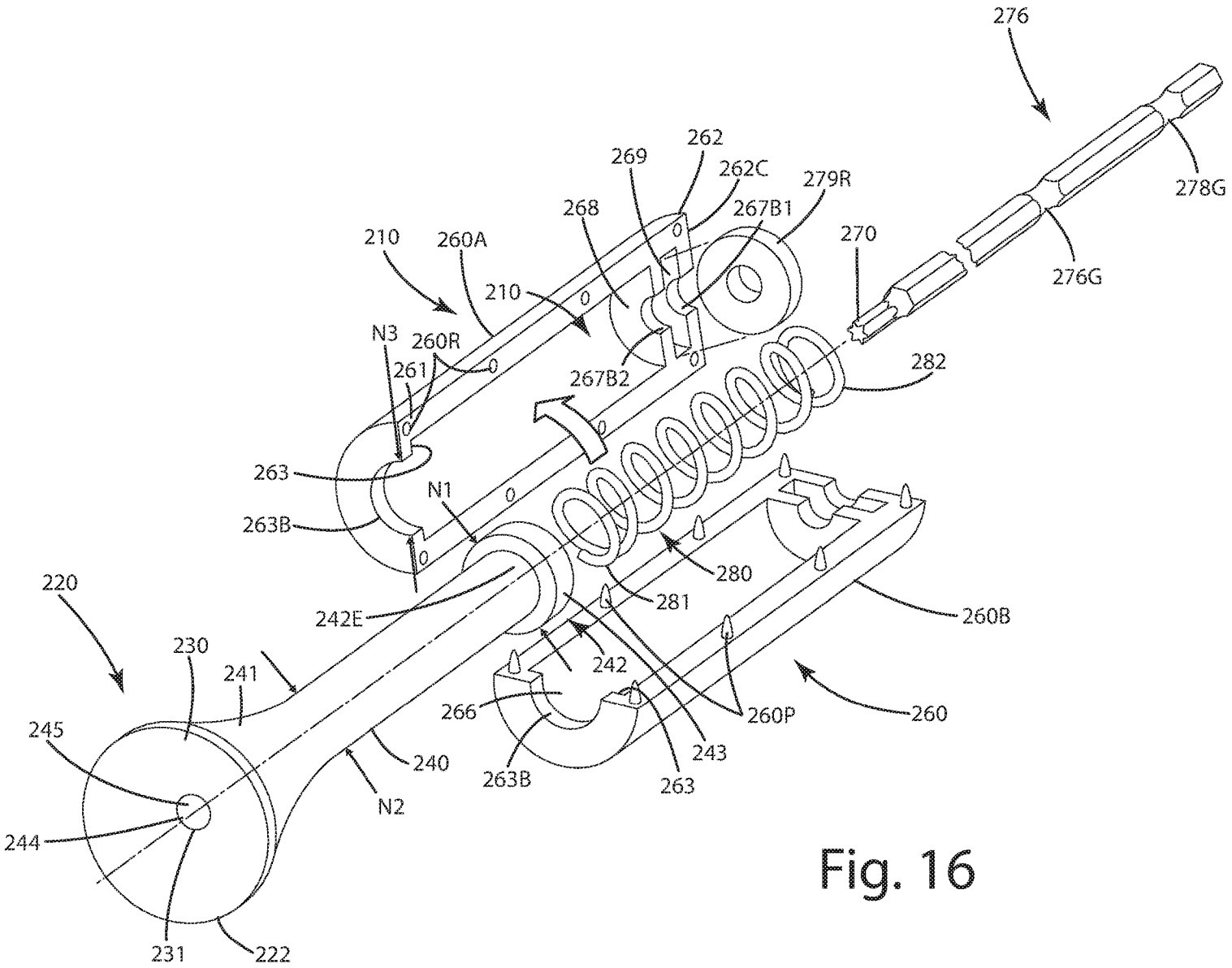
FIG. 16 is an exploded view of the fastener guide of the second alternative embodiment.

With reference to FIGS. 15-16, the fastener guide 210 can include the elongated barrel 240, which itself can be movably, slidably and/or telescopically joined with a guide sleeve 260. As mentioned above, the bit 276 can extend through the guide sleeve 260 and through the elongated barrel 240. The elongated barrel 240 can define a bore 245 that is bounded by an inner side wall 244, having dimensions similar to that of the current embodiment of the guide 10 described above. The elongated barrel 240 can include a lower end 241 and an upper end 242. The lower end 241 can transition to the downward opening funnel 220, which can terminate at a lowermost surface or portion 222. The bore 245 can extend from the lower end 241 to the upper end 242. The upper end 242 can include a projection 243. This projection as shown can be an annular shoulder that extends around the elongated barrel, and outward from its exterior surface 242E near the upper end. The projection 243 can be configured to interface with a corresponding stop 263 that is included in the guide sleeve 260. The projection 243 can be configured to abut against the stop 263 to prevent the elongated barrel 240 and its associated downward extending funnel 230 from becoming disassociated from the guide sleeve 260. The projection 243 as mentioned above, can form an annular ring having a diameter N1. The elongated barrel itself can have a diameter second N2. The guide sleeve 260 can include an aperture having a diameter N3 within the stop 263. The diameter N2 can be smaller then the diameter N3, while the diameter N1 can be greater than the diameter N3 and the diameter N2. Within the set up, the elongated barrel 240 can slide within the bore 263B. The projection 243 with its larger diameter N1, does not enter the bore 263B and instead abuts against the stop 263 to prevent that elongated barrel and the associated downward extending funnel from being disassociated from or removed from the guide sleeve 260 as described below.

Turning now to the guide sleeve 260 shown FIGS. 15 and 16, the guide sleeve 260 can include the stop 263 at its lower end 261 which itself is distal from the upper end 262 of the guide sleeve 260. The guide sleeve 260 can be constructed from two opposing halves 260A and 260B. These halves can be aligned, registered and secured together via a system of posts 260P and recesses 260R that interfit within one another. The two opposing halves can be secured together via a cement, sonic welding, melting and/or with fasteners. These two components are constructed such that the projections or ring 243 of the elongated barrel 240 can be easily assembled, placed and trapped within the internal movement chamber 266 of the guide sleeve 260. This internal movement chamber 266 can extend from the stop 263 at the first lower end 261 to the upper end 262 of the guide sleeve. The upper end 262 of the guide sleeve can include a closure 262C, which generally closes off the upper end 262 of the guide sleeve 260. The closure 262C can define a bit bore 267B1 that has a diameter larger than the diameter of the bit 276 so that the bit shaft can slide into and can be removed from the fastener guide 210.

Optionally, the guide sleeve 260 can include a retainer flange 268 that is spaced from the closure 262C in the upper end 262. This retainer flange 268 can define a bit bore 267B2 that has a diameter larger than the diameter of the bit 276 so the bit can slide into and can be removed from the fastener guide 210. The bores 267B1 and 267B2 can be aligned with one another. Between the closure 262C and the retainer flange 268, a cavity 269 can be formed. This cavity 269 can be configured to retain a ring 279R which is configured to interface in and with the groove 276G of the bit 276. This ring 279R can be in the form of an elastomeric ring, such as a rubber O-ring. Of course, the ring can be constructed of other materials such as plastic polymers, metal or the like. Further, the ring can include fingers or other elements that can adequately engage the groove 276G to temporarily and removably secure the bit 276 within the guide sleeve and elongated bore. Of course, in other constructions, different types of fasteners, such as set screws, can be associated with the guide sleeve 260 to secure the bit 276 temporarily or in some cases permanently to the fastener guide 210.

Figure 17:
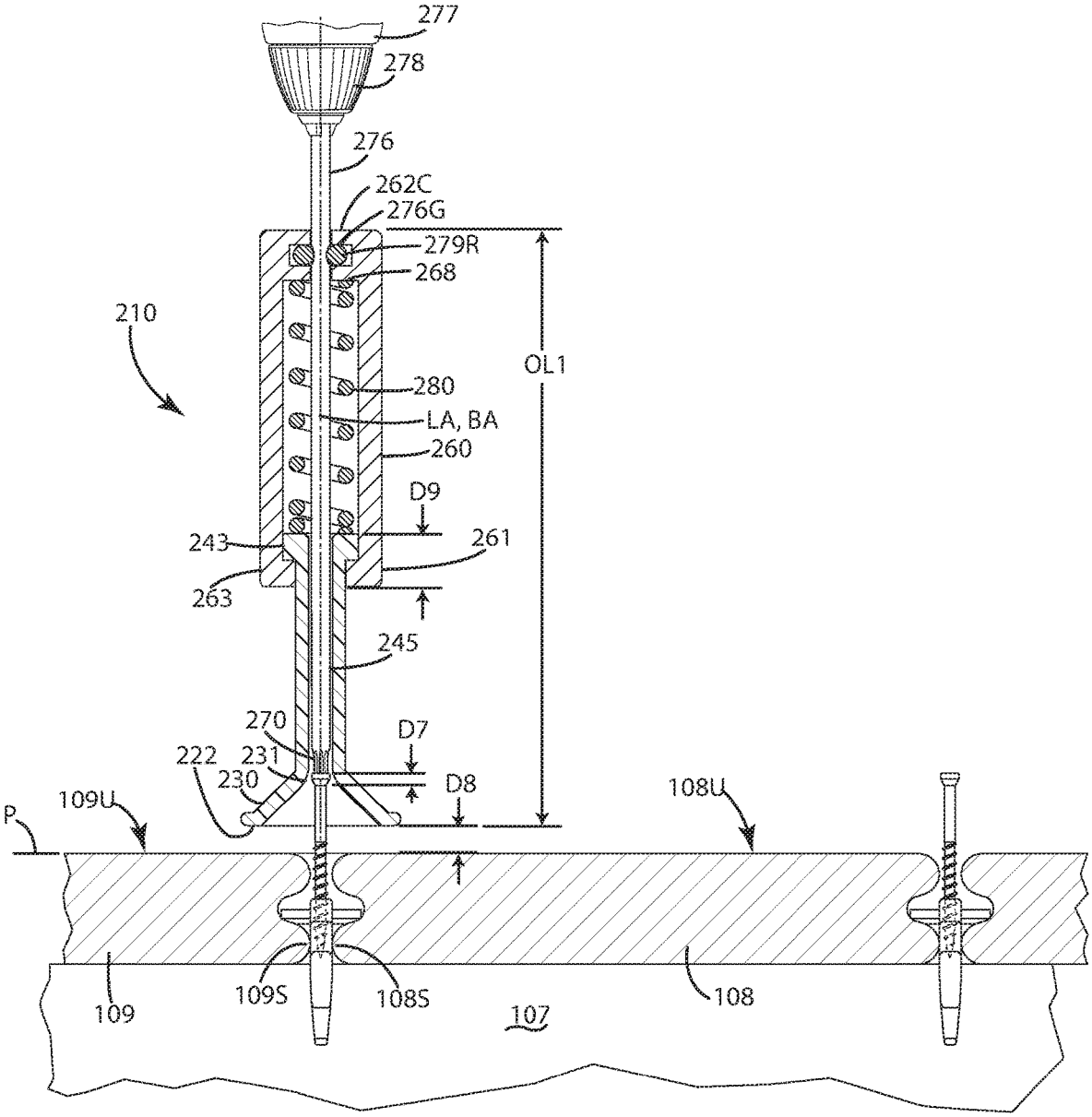
FIG. 17 is a section side view of the fastener guide of the second alternative embodiment installed relative to a fastener, with an elongated barrel being in an extended mode and the fastener guide secured to a power tool.
Figure 18:
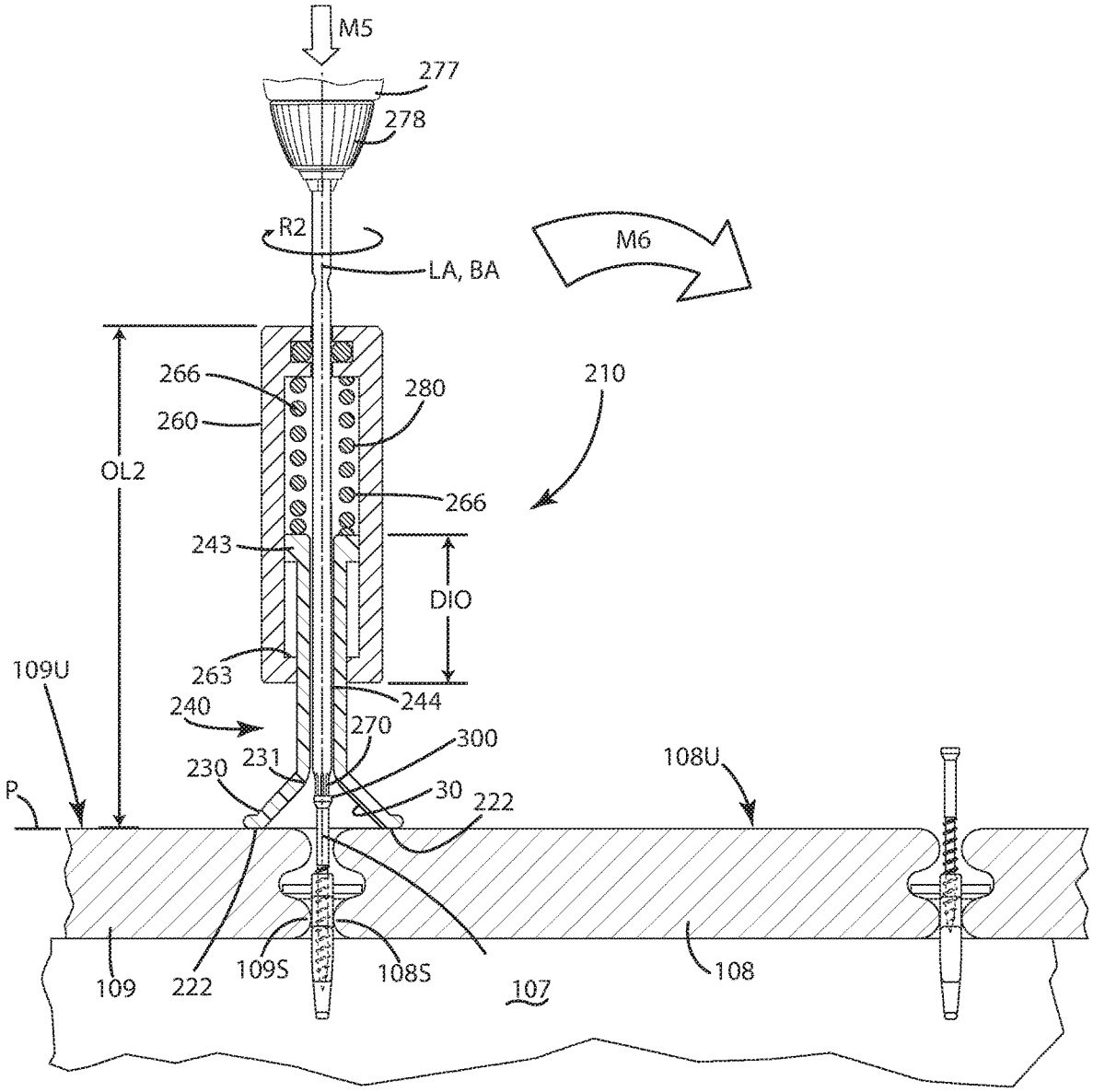
FIG. 18 is a section side view of the fastener guide installed relative to the fastener, with a drive feature engaging and advancing the fastener within the fastener guide, with the downward opening funnel engaged against a board, and with the elongated barrel in a retracted mode and a biasing element being compressed during advancing of the fastener.

As shown in FIGS. 16-18, the guide sleeve 260 can be configured to include a biasing element 280. This biasing element 280 can be in the form of a coil spring. This coil spring can include a lower end 281 and an upper end 282 with multiple coils there between. Although shown as a coil spring, the biasing element 280 can be a leaf spring, and elastomeric element, a magnetically bias or some other biasing structure. The coil spring 280 can include an inner diameter that is sized slightly larger than the shaft and drive feature 270 of the bit 276 so that those elements can move freely through the inner diameter of the spring. The outer diameter of the biasing element 280 can be sized such that it is smaller than the diameter of the internal movement chamber 266. In this manner, the biasing element 280 can be compressed and can extend inside that chamber 266. Generally, when the fastener guide 210 is assembled, the biasing element, for example the coil spring, can surround or circumferentiate the bit 276 that extends at least partially through the spring. When assembled, the spring ends 281 and 282 can respectively engage the projection 243 of the elongated barrel, as well as the rim 268 of the guide sleeve 260.

Methods of using the fastener guide 210 of the second alternative embodiment will now be described with reference to FIGS. 16-18. The fastener guide 210 can be supplied with or without a bit 276. The bit 276 can be installed relative to the fastener guide 210 by inserting the drive feature 270, first through the bore 267B1, then through the ring 279R, then through the bore 267B2, through the internal movement cavity 266, through the internal diameter of the compression spring 280, within that cavity 266, and into the internal bore 245 of the elongated barrel 240. The drive feature 270 can be installed in the bore 245 and generally in the elongated barrel 240 such that it is disposed a distance D7 from the upper and or opening 231 of the void of the downward opening funnel 230. This distance D7 can be optionally less than 30 mm, less than 20 mm, less than 15 mm, less than 10 mm, less than 5 mm, between 30 mm and 1 mm, inclusive, between 20 mm and 1 mm inclusive, between 15 mm and 1 mm inclusive, between 10 mm and 1 mm inclusive, or between 5 mm and 1 mm inclusive. This distance can be selected to ensure that the overall length OL1 of the fastener guide 210 does not become overly elongated such that it is unwieldy or prone to breakage due to its length, yet enough so that a head 300H of a fastener 300 can enter the elongated barrel and/or its bore enough so that the drive feature 270 can satisfactorily engage a corresponding drive feature in that head 300H.

When the bit 276 is inserted, into the fastener guide, eventually, the where included, the retainer groove 276G is engaged by the retainer ring 279R. This retainer ring interfaces with the groove so that the bit 276 can rotate relative to the ring, as well as the guide sleeve 260, the biasing element 280, the elongated barrel 240 and the downward extending funnel 230 and their relative components. The ring 279R can in turn temporarily secure the bit 276 to the fastener guide 210. This bit of course also can be removable and replaceable relative to the fastener sleeve, by exerting a force to disengage the groove and ring from one another.

Turning now to FIGS. 17 and 18, the method generally can include moving the guide 210 toward a fastener 300 so that the downward opening funnel 230 moves over a head 300H of the fastener 300. The head 300H can enter the elongated barrel 240, for example, the bore 245 of the barrel above the downward opening funnel in which the head engages the drive feature 270 of the bit 276 so that the head 300H and drive feature 270 can rotate in unison. The head 270 can be rotated in the elongated barrel 240 with the drive feature located in the elongated barrel such that the elongated barrel rotationally constrains the head and the drive feature. The head 300H can be advanced with the drive feature 270 so that the head passes into the downward opening funnel 230, in particular its void from the elongated barrel 240 with the drive feature engaging the head, but so that the elongated barrel no longer rotationally constrains the head.

As shown in FIG. 17, the fastener guide 210, with a bit 276 associated therewith via the interaction of the ring 279R in the groove 276G, can be attached to a power tool 276 via a chuck 278. The power tool 276 can be moved in a direction toward the fastener 300, and in particular, the fastener head 300H. Due to the attachment of the bit and thus the fastener guide to the power tool, the power tool alone can be the only item moved manually by a user. The fastener guide and its components thus move along with the power tool so that manual manipulation of the fastener guide 210 directly is not always needed. Of course, if a user desires to manually engage the pastor guide, for example the guide sleeve 260 to assist in the guiding of the downward opening funnel 230 toward the fastener, the user may do so. As illustrated, the fastener 300 is associated with a clip of the type explained above that is disposed between side surfaces of adjacent boards 108, 109. The fastener 300 can be held in an upright, vertical orientation via the clip joined with a joist underlying the boards with the fastener 300 immediately adjacent the board side surfaces 108S, 109S. As noted with the embodiment above, during the advancing the fastener step, the head of a fastener 300H can move downward adjacent board side surfaces predetermined distance until the head engages the clip. During the advancing of the fastener step, the drive feature also extends a distance downward, past and beyond the lowermost engagement surface 222 of the funnel. This distance can be optionally greater than 1 mm, greater than 2 mm, greater than 5 mm, greater than 10 mm, greater than 20 mm, greater than 30 mm, between 1 mm and 30 mm inclusive, between 1 mm and 20 mm inclusive, between 1 mm and 10 mm inclusive, or between 5 mm and 15 mm inclusive.

The fastener guide 210, associated with the end of the tool 277, can be moved such that the inside surfaces of the downward opening funnel 230 engage the fastener head 300H. Due to the concavity and shape of the downward opening funnel 230, the head 300H is guided into the bore 245 of the elongated barrel 245, where it encounters the drive feature 270. The elongated barrel can be moved so that the head 300H enters the elongated barrel 240 a distance D7, which can be the distance as noted above. As an example, the head can enter the elongated barrel a distance of optionally less than 15 mm, less than 10 mm, between 1 mm and 15 mm inclusive, at which point the drive feature 270 engages a corresponding drive feature hole of the head 300H or the fastener 300 in general. Upon this engagement of the drive feature with the head 300H, the downward opening funnel 230 is spaced a distance D8 from the upper surfaces 108U, 109U of the boards 108 and 109. In particular, the lowermost engagement surface surface 222 of the funnel 230 or the entire guide is spaced distal from and out of engagement with the boards and the respective upper surfaces thereof. The downward opening funnel and a lower most engagement surface can be spaced the distance D8 from those upper surfaces of the boards. This distance D8 optionally can be less than 30 mm, less than 20 mm, less than 10 mm, less than 5 mm, less than 1 mm, between 30 mm and one millimeters inclusive, between 20 mm and 1 mm inclusive, between 10 mm and 1 mm inclusive, or between 5 mm and 1 mm inclusive. In this construction, the downward opening funnel 230 and the fastener guide 210 in general do not contact or engage the boards or their upper surfaces respectively.

In this configuration, the fastener guide 210 can have an overall length, which can be measured from the uppermost surface of the closure 262C to the lowermost surface of the downward opening funnel 222. This overall length OL1 can be decreased to a second overall length OL2 when the elongated barrel is retracted to a retracted mode as shown in FIG. 18. In particular, the elongated barrel 240 is in an extended mode as shown in FIG. 17. In this extended mode, the projection 243 can engage the stop 263. The overall length can be OL1 in the extended mode, which can be greater than the overall length OL2 described below in connection with the retracted mode. The biasing element 280 can be partially or fully extended and can engage the rim 268 of the guide sleeve 260 at its upper end, and the projection 243 at its lower end. Where the spring engages the ring 243 or the barrel 240 in general, it pushes the barrel to the extended mode. Optionally, when the barrel is in the extended mode, the ring 243 can be spaced a distance D9 from the lowermost portion of the guide sleeve 60. As explained below, this distance D9 can be less than the distance D2 when the elongated barrel is in the retracted mode.

The elongated barrel can telescopically move or slide relative to the guide sleeve 260. As shown in FIG. 18, the drive feature 270 can engage the fastener head 300H or the fastener 300 in general. The drive feature 270 can rotate with the bit in direction R2 powered by the power tool 277. As the fastener 300 rotates, it advances further through the clip and into the joist 107. As the fastener advances, the fastener guide 210 descends toward the upper surfaces 108U and 109U of the boards. The downward opening funnel guide 230, in particular, the lowermost engagement surface 222 can engage those upper surfaces of the boards upon sufficient advancement of the fastener into the joist and/or the clip.

During the advancement of the drive feature and/or the fastener head in the elongated barrel, and out the bore into the void of the downward opening funnel, the elongated barrel 240 can retract to the retracted mode shown in FIG. 18. The biasing element 280 can compress under the force M5 exerted through the fastener guide 210. The drive bit 276 can rotate in direction R2, even while the spring is compressed around it. The bit 276 also can rotate in the elongated barrel and its bore, as the drive feature rotates and advances through the downward extending funnel. It is to be noted that the bit 276 remains longitudinally stationary relative to the guide sleeve 260 and the retaining ring 279R, as well as the closure 262C, but that the elongated barrel and its bore, as well as the downward extending funnel, move longitudinally relative to the bit as the spring is compressed and the elongated barrel moves to the retracted mode. During this movement to the retracted mode, the guide sleeve 260 also moves downward toward the downward opening funnel 230. As mentioned above, the distance D9 also is increased to the distance D10. The overall length OL1 of the fastener guide 210 reduces to the lesser length overall length OL2 when the elongated barrel retracts to the retracted mode.

The drive feature continues to rotate and advance the fastener 300 downward toward the clip until the fastener head 300H engages a cleat of the clip to secure the clip in place and secured down the boards 108 and 109 to joist 107. Optionally, the bit and drive feature can cease rotation of the fastener upon reaching a particular torque that is generated by the head engaging the cleat. The tool 277 can be set a particular torque so that it can stop rotating the drive feature and the fastener upon satisfactory securement of the fastener and the clip relative to the board. In such a construction, the fastener guide 210 does not set the depth at which the fastener is advanced into a board, the clip or the underlying joist, rather it is the torque setting that determines the stopping of advancement of the fastener.

After the fastener and clip are installed, the user can remove the force M5 from the tool 277, in which case the elongated barrel extends to an extended mode from the guide sleeve 260 by the biasing element 280 extending and releasing its stored energy, thereby pushing on the projection 243 of the elongated barrel to extend the elongated barrel out, away from the internal movement chamber 266. In the extended mode, the projection 243 engages the stop 263 when the elongated barrel is fully extended. The overall length also increases back to OL1 from OL2. The user can move the fastener guide 210 and the associated tool 277 in direction M6, onto the next fastener to fasten down the boards by advancing the fastener into an underlying joist similar to the operation described above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z ; and Y, Z.

The embodiments of the invention in which an exclusive property or privilege is claimed are defined as follows:

1. A method of using a fastener guide to install a fastener, the method comprising:

providing a fastener in an upright, vertical orientation adjacent a board;

moving a guide from a distal location toward the fastener, the guide defining a downward opening funnel having an upper end and a lower end, the downward opening funnel widening toward the lower end, the guide including an elongated barrel above the downward opening funnel, the elongated barrel reciprocally biased in a guide sleeve by a biasing element, the elongated barrel configured to extend from the guide sleeve in an extended mode and retract relative to the guide sleeve in a retracted mode;

positioning the downward opening funnel over a head of the fastener, so that the head of the fastener enters the elongated barrel a distance of less than 15 millimeter, and the head of the fastener is disposed in the elongated barrel, while the elongated barrel is in the extended mode;

rotating and engaging the head of the fastener with a drive feature so as to rotate the fastener; and advancing the fastener using the drive feature so that the fastener leaves the elongated barrel and travels through the downward opening funnel, with the elongated barrel transitioning to the retracted mode from the extended mode during said advancing, wherein the guide sleeve is slidably associated with the elongated barrel, wherein the elongated barrel retracts into the guide sleeve during said advancing, wherein the barrel is coaxial with the downward opening funnel.

2. The method of claim 1, wherein the biasing element is a coil spring that circumferentiates a bit during said advancing.

3. The fastener guide of claim 2, wherein the biasing element exerts a force against a rim of the guide sleeve and against a projection joined with the elongated barrel when the elongated barrel is in the retracted mode.

4. The method of claim 1, pushing against a a projection joined with the elongated barrel with the biasing element, which is in the form of a coil spring, wherein during the advancing step, the elongated barrel is urged into the guide sleeve thereby compressing the coil spring.

5. The method of claim 4, wherein during the advancing step, an overall length of the guide decreases.

6. The method of claim 1, wherein the head and drive feature are rotationally constrained in the elongated barrel before the drive feature enters the downward opening funnel, at which point the fastener is no longer rotationally constrained in the elongated barrel but is guided instead by the advancement of the drive feature downward.

7. The method of claim 1, wherein during the positioning, the head of the fastener enters the elongated barrel a distance of between 1 millimeter and 10 millimeter, inclusive.

8. The method of claim 1, wherein the downward opening funnel includes a lowermost engagement surface;

wherein the lowermost engagement surface and the guide is spaced distal from and out of engagement with the board when the head of the fastener is in the elongated barrel, while elongated barrel is in the extended mode.

9. The method of claim 1, comprising:

compressing a coil spring that circumferentiates a bit including the drive feature during said advancing.

10. The method of claim 1, wherein the distance is between 1 millimeter and 15 millimeter.

11. The method of claim 1, wherein the guide sleeve includes a stop, wherein the elongated barrel includes a projection that engages the stop to prevent elongated barrel from becoming disassociated from the guide sleeve.

12. The method of claim 1, wherein the downward opening funnel is a cone shaped void having an upper end that opens to the elongated barrel, wherein the head is of a head diameter smaller than a smallest diameter of the cone shaped void so that the head enters the elongated barrel above the upper end without being impaired from moving toward the elongated barrel by a surface of the downward opening funnel.

13. The method of claim 1 comprising:

urging the elongated barrel to the extended mode with the biasing element;

engaging the downward opening funnel with the fastener head when the elongated barrel is in the extended mode; and compressing the biasing element when the downward opening funnel engages the board as the fastener advances.

14. The method of claim 1, wherein the drive feature is joined with a bit including an annular groove, wherein the guide sleeve includes a retention ring, wherein the retention ring is disposed in the annular groove to secure the bit in the guide sleeve and the elongated barrel, but to allow the bit to rotate relative to at least one of the guide sleeve and the elongated barrel during the advancing step.

15. A method of using a fastener guide to install a fastener, the method comprising:

providing a fastener in an upright, vertical orientation adjacent a board;

moving a guide from a distal location toward the fastener, the guide defining a downward opening funnel having an upper end and a lower end, the downward opening funnel widening toward the lower end, the guide including an elongated barrel above the downward opening funnel, the elongated barrel reciprocally biased in a guide sleeve by a biasing element, the elongated barrel configured to extend from the guide sleeve in an extended mode and retract relative to the guide sleeve in a retracted mode;

positioning the downward opening funnel over a head of the fastener, so that the head of the fastener enters the elongated barrel a distance, and the head of the fastener is disposed in the elongated barrel, while the elongated barrel is in the extended mode;

rotating and engaging the head of the fastener with a drive feature so as to rotate the fastener; and advancing the fastener using the drive feature so that the fastener leaves the elongated barrel and travels through the downward opening funnel, with the elongated barrel transitioning to the retracted mode from the extended mode during said advancing, wherein the fastener is held in the upright, vertical orientation via a clip joined with a joist underlying the board, wherein the fastener is immediately adjacent a side surface of the board, wherein during the advancing the fastener step, the head of the fastener moves downward adjacent the side surface of the board a predetermined distance until the head engages the clip.

16. The method of claim 5, A method of using a fastener guide to install a fastener, the method comprising:

providing a fastener in an upright, vertical orientation adjacent a board;

moving a guide from a distal location toward the fastener, the guide defining a downward opening funnel having an upper end and a lower end, the downward opening funnel widening toward the lower end, the guide including an elongated barrel above the downward opening funnel, the elongated barrel reciprocally biased in a guide sleeve by a biasing element, the elongated barrel configured to extend from the guide sleeve in an extended mode and retract relative to the guide sleeve in a retracted mode;

positioning the downward opening funnel over a head of the fastener, so that the head of the fastener enters the elongated barrel a distance, and the head of the fastener is disposed in the elongated barrel, while the elongated barrel is in the extended mode;

rotating and engaging the head of the fastener with a drive feature so as to rotate the fastener;

advancing the fastener using the drive feature so that the fastener leaves the elongated barrel and travels through the downward opening funnel, with the elongated barrel transitioning to the retracted mode from the extended mode during said advancing, and moving the guide sleeve downward toward the downward opening funnel, wherein the drive feature is included on a bit, wherein the bit rotates, wherein the bit remains longitudinally stationary relative to the guide sleeve as the guide sleeve moves downward toward the downward opening funnel so that the guide sleeve and the bit move as a unit.

* * * * *